US011204156B2

(12) United States Patent
Stegeman et al.

(10) Patent No.: US 11,204,156 B2
(45) Date of Patent: Dec. 21, 2021

(54) SYSTEMS AND METHODS FOR AGGREGATING EDGE SIGNALS IN A MESH NETWORK

(71) Applicant: LABYRINTH TECHNOLOGIES, LLC, Hazelwood, MO (US)

(72) Inventors: John T. Stegeman, Hazelwood, MO (US); Theodore J. Stegeman, Hazelwood, MO (US)

(73) Assignee: LABYRINTH TECHNOLOGIES, LLC, Hazelwood, MO (US)

( * ) Notice: Subject to any disclaimer, the term of this patent is extended or adjusted under 35 U.S.C. 154(b) by 142 days.

(21) Appl. No.: 16/694,529

(22) Filed: Nov. 25, 2019

(65) Prior Publication Data

US 2020/0088390 A1 Mar. 19, 2020

Related U.S. Application Data

(63) Continuation-in-part of application No. 16/448,941, filed on Jun. 21, 2019, now Pat. No. 10,697,620, and
(Continued)

(51) Int. Cl.
*H05B 47/19* (2020.01)
*F21V 21/116* (2006.01)
(Continued)

(52) U.S. Cl.
CPC ..... *F21V 21/116* (2013.01); *F21S 8/086* (2013.01); *F21V 23/008* (2013.01); *F21V 31/00* (2013.01);
(Continued)

(58) Field of Classification Search
CPC ..... F21V 21/116; F21V 31/00; F21V 23/008; H05B 47/11; H05B 47/115; H05B 47/19;
(Continued)

(56) References Cited

U.S. PATENT DOCUMENTS 4,731,551 A 3/1988 Gibbs et al.
5,235,252 A 8/1993 Blake
(Continued)

FOREIGN PATENT DOCUMENTS

CN 104520636 A 4/2015
DE 7723862 U1 12/1978
(Continued)

OTHER PUBLICATIONS

Perry, Tekla S., "San Diego's Smart Streetlights Yield a Firehose of Data," Spectrum IEEE website, https://pectrum.ieee.org/view-from-the-valley/computing/networks/sandiegos-smart-streetlight-network-yielding-a-firehose-of-data, dated Jan. 16, 2019, printed on Sep. 18, 2019 (4 pages).
(Continued)

*Primary Examiner* — Donald L Raleigh
(74) *Attorney, Agent, or Firm* — Lewis Rice LLC

(57) ABSTRACT

Systems and methods for modifying a municipal fixture to affix endpoint devices, provide a power to such devices, and managing network traffic between and among such devices, including managing upstream transmission and efficiently propagating desired state changes through the network. The systems and methods described herein generally use a plurality of mesh radio transmitters which are configured for peer-to-peer data exchange to propagate system state changes to one or more uplink gateways. The gateways may then aggregate this data and transmit it over a wide area network to a server or server farm for processing, analysis, and other use. That data may also be viewed in real time by user devices, and instructions and commands may also be relayed to the individual IoT devices in the mesh network via such user devices.

19 Claims, 13 Drawing Sheets

Related U.S. Application Data a continuation-in-part of application No. 29/680,947, filed on Feb. 21, 2019, and a continuation-in-part of application No. 16/409,213, filed on May 10, 2019, now Pat. No. 10,495,291, which is a continuation of application No. 16/384,898, filed on Apr. 15, 2019, which is a continuation of application No. 15/656,675, filed on Jul. 21, 2017, now Pat. No. 10,260,719.

(60) Provisional application No. 62/792,213, filed on Jan. 14, 2019, provisional application No. 62/806,300, filed on Feb. 15, 2019, provisional application No. 62/368,574, filed on Jul. 29, 2016, provisional application No. 62/688,194, filed on Jun. 21, 2018.

(51) Int. Cl.

| | |
|---|---|
| ***F21V 31/00*** | (2006.01) |
| ***F21V 23/00*** | (2015.01) |
| ***F21S 8/08*** | (2006.01) |
| ***H05B 47/105*** | (2020.01) |
| ***H05B 47/11*** | (2020.01) |
| ***H05B 47/115*** | (2020.01) |
| *F21Y 115/10* | (2016.01) |
| *F21W 131/103* | (2006.01) |

(52) U.S. Cl.

CPC ..... *H05B 47/105* (2020.01); *H05B 47/11* (2020.01); *H05B 47/115* (2020.01); *H05B 47/19* (2020.01); *F21W 2131/103* (2013.01); *F21Y 2115/10* (2016.08)

(58) Field of Classification Search

CPC .... H05B 47/105; F21S 8/086; F21Y 2115/10; F21W 2131/103; Y02B 20/40

See application file for complete search history.

(56) References Cited

U.S. PATENT DOCUMENTS

| | | | | |
|---|---|---|---|---|
| 5,651,612 | A | 7/1997 | Braun | |
| 5,895,986 | A | 4/1999 | Walters et al. | |
| 6,452,339 | B1 | 9/2002 | Morrissey et al. | |
| 6,462,775 | B1 | 10/2002 | Loyd et al. | |
| 6,811,444 | B2 | 11/2004 | Geyer | |
| 7,406,298 | B2 | 7/2008 | Luglio et al. | |
| 7,706,757 | B2 | 4/2010 | Luglio et al. | |
| 7,723,862 | B1 | 5/2010 | Spillman et al. | |
| 7,828,463 | B1 | 11/2010 | Willis | |
| 8,120,280 | B2 | 2/2012 | Yi et al. | |
| 8,140,276 | B2 | 3/2012 | Walters et al. | |
| 8,382,387 | B1 | 2/2013 | Sandoval | |
| 8,442,785 | B2 | 5/2013 | Walters et al. | |
| 8,502,408 | B2 | 8/2013 | Schneider et al. | |
| 8,558,413 | B1 | 10/2013 | Lepard | |
| 8,588,942 | B2 | 11/2013 | Agrawal | |
| 8,693,965 | B2 | 4/2014 | McKay et al. | |
| 8,866,582 | B2 | 10/2014 | Verfuerth et al. | |
| 9,148,934 | B2 | 9/2015 | Matsuki | |
| 9,175,954 | B2 | 11/2015 | Koerner et al. | |
| 9,198,264 | B2 | 11/2015 | Challapali et al. | |
| 9,226,368 | B2 | 12/2015 | Agrawal | |
| 9,301,365 | B2 | 3/2016 | Reed | |
| 9,326,359 | B2 | 4/2016 | Bosua | |
| 9,338,862 | B2 | 5/2016 | Noesner et al. | |
| 9,387,928 | B1 | 7/2016 | Gentry et al. | |
| 9,526,142 | B2 | 12/2016 | Schroder et al. | |
| 9,593,843 | B2 | 3/2017 | McRory | |
| 9,651,420 | B2 | 5/2017 | Weber | |
| 9,795,003 | B2 | 10/2017 | Johnson | |
| 9,907,147 | B2 | 2/2018 | Chen et al. | |
| 10,094,546 | B2 | 10/2018 | Agrawal et al. | |
| 10,154,571 | B2 | 12/2018 | Lai et al. | |
| 10,205,345 | B2 | 2/2019 | Tuerk et al. | |
| 10,219,360 | B2 | 2/2019 | Vendetti et al. | |
| 10,238,001 | B2 | 3/2019 | Agrawal et al. | |
| 10,374,282 | B2 | 8/2019 | Johnson et al. | |
| 10,378,735 | B1 | 8/2019 | Patel | |
| 10,390,414 | B2 | 8/2019 | Vendetti et al. | |
| 10,403,959 | B2 | 9/2019 | Johnson et al. | |
| 10,568,191 | B2 | 2/2020 | Vendetti et al. | |
| 2003/0152423 | A1 | 8/2003 | Wu | |
| 2004/0100793 | A1 | 5/2004 | Monitto | |
| 2004/0105264 | A1 | 6/2004 | Spero | |
| 2005/0168169 | A1 | 8/2005 | Kurachi et al. | |
| 2006/0044789 | A1 | 3/2006 | Curtis | |
| 2007/0013513 | A1 | 1/2007 | Tang et al. | |
| 2008/0106892 | A1 | 5/2008 | Griffiths et al. | |
| 2008/0175216 | A1 | 7/2008 | Nasco | |
| 2009/0206670 | A1 | 8/2009 | Whitted et al. | |
| 2011/0058358 | A1 | 3/2011 | Soo et al. | |
| 2011/0171080 | A1 | 7/2011 | Lo | |
| 2011/0187270 | A1 | 8/2011 | Summerford et al. | |
| 2012/0020060 | A1 | 1/2012 | Myer et al. | |
| 2012/0051050 | A1 | 3/2012 | Lee et al. | |
| 2012/0143383 | A1 | 6/2012 | Cooperrider et al. | |
| 2012/0327639 | A1 | 12/2012 | Chen | |
| 2013/0040471 | A1 | 2/2013 | Gervais et al. | |
| 2013/0064136 | A1 | 3/2013 | Apostolakis | |
| 2013/0077327 | A1 | 3/2013 | Butler et al. | |
| 2013/0107520 | A1 | 5/2013 | O'Kane | |
| 2013/0142372 | A1 | 6/2013 | Harwood | |
| 2013/0193876 | A1* | 8/2013 | Cleland | H05B 47/16 315/297 |
| 2014/0016356 | A1 | 1/2014 | Furmanczyk et al. | |
| 2014/0028200 | A1 | 1/2014 | Wagoner et al. | |
| 2014/0052390 | A1 | 2/2014 | Kim et al. | |
| 2014/0071677 | A1 | 3/2014 | Pickard et al. | |
| 2014/0211487 | A1 | 7/2014 | Spiro | |
| 2014/0312776 | A1 | 10/2014 | Park et al. | |
| 2015/0016159 | A1 | 1/2015 | Deboy | |
| 2015/0115807 | A1 | 4/2015 | Schroder et al. | |
| 2015/0264776 | A1 | 9/2015 | Amarin et al. | |
| 2015/0362172 | A1 | 12/2015 | Gabriel et al. | |
| 2015/0369618 | A1 | 12/2015 | Barnard et al. | |
| 2016/0095182 | A1 | 3/2016 | Bjorn et al. | |
| 2016/0286629 | A1 | 9/2016 | Chen et al. | |
| 2016/0318568 | A1 | 11/2016 | Hosoda et al. | |
| 2016/0320049 | A1 | 11/2016 | Bears | |
| 2017/0146223 | A1 | 5/2017 | Chaoua et al. | |
| 2017/0310232 | A1 | 10/2017 | De Hoog et al. | |
| 2018/0031213 | A1 | 2/2018 | Stegeman et al. | |
| 2018/0045388 | A1 | 2/2018 | McDowell et al. | |
| 2018/0116040 | A1 | 4/2018 | Mann et al. | |
| 2018/0235060 | A1* | 8/2018 | Vendetti | H05B 47/11 |
| 2018/0279429 | A1 | 9/2018 | Sadwick | |
| 2018/0288860 | A1 | 10/2018 | Vendetti et al. | |
| 2018/0295703 | A1 | 10/2018 | Xue et al. | |
| 2019/0017667 | A1 | 1/2019 | Mitchell et al. | |
| 2019/0279429 | A1 | 9/2019 | Chen et al. | |
| 2019/0305551 | A1 | 10/2019 | Ley et al. | |
| 2019/0305554 | A1 | 10/2019 | Sharifipour et al. | |
| 2019/0305688 | A1 | 10/2019 | Seymour | |
| 2019/0360667 | A1 | 11/2019 | Patel | |
| 2019/0380191 | A1 | 12/2019 | Wu et al. | |
| 2020/0020480 | A1 | 1/2020 | Coquinco | |
| 2020/0045794 | A1 | 2/2020 | Reed et al. | |

FOREIGN PATENT DOCUMENTS

| | | | | |
|---|---|---|---|---|
| DE | 8812785 | U1 | 10/1988 | |
| EP | 3018977 | A1 | 5/2016 | |
| EP | 3290788 | A1 | 3/2018 | |
| FR | 2399019 | A1 | 2/1979 | |
| GB | 2444734 | A | 6/2008 | |
| KR | 101585531 | B1 * | 1/2016 | H05B 37/0263 |
| KR | 101585531 | B1 | 1/2016 | |
| WO | 2014066298 | A1 | 5/2014 | |
| WO | 20140184166 | A2 | 11/2014 | |
| WO | 2016053034 | A1 | 4/2016 | |

(56) References Cited

FOREIGN PATENT DOCUMENTS

| | | | |
|---|---|---|---|
| WO | 2016075116 | A2 | 5/2016 |
| WO | 2017139089 | A1 | 8/2017 |

OTHER PUBLICATIONS

Labyrinth Technologies—4G & 5G Poles https://labyrinth-tech.com/solutions/small-cell-facilites.html Apr. 2019 (Year: 2019).

International Search Report and Written Opinion for related application No. PCT/US2020/013523, dated Jul. 6, 2020, 16 pages.

Brunhuber, Kim, "In San Diego, a lamppost can tell you where to park," CBC News website, Technology & Science, https://www.cbc.ca/news/technology/san-diego-smart-city-parking-1.4498964, dated Feb. 7, 2018, printed on Sep. 18, 2019 (5 pages).

Bigelow, Bruce V., "GE Plans a Sale as San Diego Smart City Project Nears Completion," Xconomy website, San Diego, https://xconomy.com/san-diego/2018/06/14/ge-plans-a-sale-as-san-diegosmart-city-project- nears-completion/, dated Jun. 14, 2018, printed on Sep. 18, 2019 (2 pages).

Maddox, Teena, "New smart city traffic project takes off in Portland, OR," TechRepublic website, dated Jun. 20, 2018, printed on Sep. 18, 2019 (4 pages).

Goldstein, Phil, "Portland Turns to Smart Sensors to Enhance Traffic Safety," StateTech Magazine website, https://www.techrepublic.com/article/new-smart-city-traffic-project-takes-offin-portland-or/, dated Jul. 30, 2018, printed on Sep. 18, 2019 (3 pages).

Chakrabarty, Gargi, "Portland Deploys Sensors to Make Street Safer," Icons of Infrastructure website, https://iconsofinfrastructure.com/portland-uses-sensors-to-make-streetssafer/, printed on Sep. 18, 2019 (2 pages).

"SmartCities," Clean Tech San Diego website, http://cleantechsandiego.org/smart-cities-home/, printed on Sep. 18, 2019 (7 pages).

"GE smart lighting technology expected to save City of San Diego more than $250K annually," LEDs Magazine, https://www.ledsmagazine.com/company-newsfeed/article/16684696/ge-smart-lighting-expected-to-save-city-of-san-diego-more-than-250k-annually, dated Jan. 29, 2014, printed on Jan. 24, 2020 (16 pages).

Wright, Maury, "Oceanside installs GPS-enabled LED street lights from GE Lighting," LEDs Magazine, https://www.ledsmagazine.com/architectural-lighting/outdoor-lighting/article/16696766/oceanside-installs-gpsenabled-led-street-lights-from-ge-lighting, dated Jul. 20, 2015, printed on Jan. 24, 2020 (22 pages).

"GE Lighting talks controls and networks at Lightfair International 2013," LEDs Magazine, https://www.ledsmagazine.com/leds-ssl-design/networks-controls/article/16697295/ge-lighting-talks-controls-and-networks-at-lightfair-international-2013, dated Apr. 24, 2013, printed on Jan. 24, 2020 (19 pages).

"LightGrid Outdoor Wireless Control System," https://products.gecurrent.com/control-systems/lightgrid-outdoor-wireless-control-system, printed on Jan. 24, 2020 (17 pages).

"LightGrid Outdoor Wireless Control System," https://facilityexecutive.com/2018/lightgrid-outdoor-wireless-control-system/, dated Mar. 30, 2018, printed on Jan. 24, 2020 (5 pages).

Marcelo Schupbach, "Next-Gen LED Lighting Designs Driven by SiC Devices", 2015, www.wolfspeed.com.

* cited by examiner

SYSTEMS AND METHODS FOR AGGREGATING EDGE SIGNALS IN A MESH NETWORK

CROSS-REFERENCE TO RELATED APPLICATIONS

This application claims the benefit of U.S. Prov. Pat. App. No. 62/792,213, filed Jan. 14, 2019, and claims the benefit of U.S. Prov. Pat. App. No. 62/806,300, filed Feb. 15, 2019, and is a continuation-in-part of U.S. patent application Ser. No. 16/409,213, filed May 10, 2019, which is a continuation of U.S. patent application Ser. No. 16/384,898, filed Apr. 15, 2019, which is a continuation of U.S. patent application Ser. No. 15/656,675, filed Jul. 21, 2017, and issued as U.S. Pat. No. 10,260,719 on Apr. 16, 2019, which claims the benefit of U.S. Prov. Pat. App. No. 62/368,574, filed Jul. 29, 2016. This application is also a continuation-in-part of U.S. patent application Ser. No. 16/448,941, filed Jun. 21, 2019, which claims the benefit of U.S. Prov. App. No. 62/688,194, filed Jun. 21, 2018, and U.S. Prov. Pat. App. No. 62/792,213, filed Jan. 14, 2019. This application is also a continuation-in-part of U.S. patent application Ser. No. 29/680,947, filed Feb. 21, 2019. The entire disclosures of all of these cases is incorporated herein by reference.

BACKGROUND OF THE INVENTION

Field of the Invention

This disclosure is related to the field of network communications. In particular, it relates to systems and methods for aggregating signals in a mesh network.

Description of the Related Art

The "smart" movement is an attempt to utilize interconnected devices as a way to generate data and supply improved and more targeted services. The basic concept is that when "things" can communicate with each other and with users, a wealth of data can be made available, often in real time, which can then be accumulated and analyzed without the need for users to manually gather, store, and organize this information.

One area where this concept is now being implemented is in the "smart city" movement, in which municipalities leverage various types of automated data collection to provide information that can be used to manage municipal assets and resources in an efficient and effective manner. These efforts rely on a variety of data sources, ranging from data collected automatically by devices in various locations throughout the city, to devices carried by citizens or employees. Data may also be collected by or from vehicles, or provided directly by citizens. "Smart city" strategies can help improve the delivery and efficiency of city services, such as law enforcement, trash collection, public safety, traffic management, and even achieve reductions in pollution and crime.

Commonly, "Internet of Things," or IoT, devices are leveraged in a smart city to obtain real-time data about municipal operations. The idea is that a more accurate and up-to-date data snapshot of the city can be used to improve the quality of municipal services and optimize costs and resource utilization. These solutions are particularly attractive in densely populated areas, where the cost overhead of deploying IoT devices and collecting and monitoring data provides high information density relative to cost.

However, there are a number of challenges with smart city initiatives (or in smart systems more generally). One such challenge is determining where and how to deploy devices, as well as managing and consolidating the vast quantity of data produced for effective analysis and use. For example, all of the devices are electrically powered, which requires a source of electricity. This in turn means that devices are generally installed on municipal fixtures with an existing source of power, such as a light pole.

An example of one such prior art fixture is depicted in FIG. 1. The depicted municipal fixture (103) is in the nature of a municipal light. The depicted fixture (103) comprises a base (104) affixed to a sidewalk (106) adjacent to a street (108), with an elongated pole (105) extending vertically from the base (104). The pole (105) provides sufficient elevation to disperse illumination, allow clearance for passing pedestrians and vehicles, and inhibit tampering. Extending laterally from the pole (105) is a light arm (107). A light head (109) is attached to the light arm (107). The light head (109) contains a source of illumination (110). A power conduit runs through the pole (105) and the light arm (107) to the source of illumination (110), and an electric power line (111) is run through that conduit from a municipal power source (not depicted) to power the source of illumination (110). Typically, the source of illumination is a municipal luminaire (110).

However, municipal lights have various power supply configurations, sometimes even within the same cluster of lights. This in turn requires a multitude of different, expensive power adapters to be deployed. If the lights are later rewired or the power characteristics change, all of the power supplies must be replaced. Further, each individual device on or within the fixture (103) may have different power requirements, which in turn can require a single fixture (103) to be equipped with multiple power conversion units for each device.

Another problem is that even once the devices are installed and powered, to get real-time data, the devices must communicate live data as it is collected. This in turn requires network access, which is difficult and expensive to deploy and manage. Most cities are very old, and it is uneconomical to run power and network wires to every device deployed in the city. Further, the quantity of data produced by any one device is typically modest, and providing a wired data solution is expensive and wasteful.

Using wireless solutions is also problematic. Although the quantity of data is often manageable through a standard short-range wireless transmission protocol, this is not always the case. Short-range wireless transmission devices have a limited transmission radius, generally measured in hundreds of feet, and up to two thousand feet at the high end. A balance must be struck between broadcast distance and bandwidth, wherein long-range transmissions have very low bitrates, and high-bitrate transmissions have very short range. This can introduce network slowdowns and dropped packets in standard wireless protocols, particularly if a particular device receives a temporary burst of activity, such as from an unexpectedly large amount of data generated at a particular device or a flood of data from other nearby devices.

In any case, even a transmission radius of two thousand feet is too small to allow all devices in a city to communicate directly with a central server so that data can be gathered, collected, analyzed, and used in real time. Each IoT device can be equipped with a broadband wireless transmitter, such as a cellular data transmitter, but this imposes significant costs and is wasteful by providing more bandwidth that is reasonably expected to be produced by any one individual device during ordinary use.

Another problem subsists in how to attach the devices and the required accompanying hardware to the fixture (103), and to communicate with new devices. For example, a typical municipal lighting pole (105) lacks sufficient suitable surfaces for attaching IoT devices, power converters, and wireless transmitters. Moreover, some of this equipment should be stored within an enclosure to minimize damage from weather and tampering. In particular, power converters must tap into the central power line (111) of the pole (105), meaning they must have access to the internal structure of the fixture (103), but a fixture (103) typically has insufficient interior volume to install the power supply. Further, each device has its own command system and communication protocol, requiring a separate communication gateway for each device.

This presents additional challenges as cities upgrade older lights to newer, more energy-efficient technologies, such as LED-based light sources. Moreover, in the continued effort of reducing power utilization related to street lights, attempts have been made to reduce power usage during off-peak times, or whenever full power is not necessary. However, such solutions have been incomplete.

Control over the luminaire (110) in a standard street light can be implemented via a dimming receptacle (115) atop the light head (109). The receptacles (115) are mechanical and electrical/physical interfaces to the luminaire (110) for control devices. For example, the ANSI C136.41 standards define multiple interface configurations facilitating various degrees of control over the luminaire (110). These include 3-, 5-, and 7-pin interface configurations.

In the simplest interface, a 3-pin configuration, the three pins provide power lines only. In the 5-pin configuration, three pins provide power and the remaining two pins provide a dimming circuit, referred to in the art as "DIM". In the 7-pin configuration, three pins provide power, two pins provide a first dimming circuit (known in the art as "DIM1"), and the final two pins provide a second dimming circuit (known in the art as "DIM2"). One problem with the ANSI C136.41 standards, particularly in 7-pin configurations, is that the dimming circuit lines are sometimes accidentally swapped. Additionally, prior art implementations have used pulse-width modulation dimming, which produces flicker when using the dimming circuits. This has led to generally unsatisfactory implementations of the standard.

Another problem with the standard is that the physical dimensions limit the available form factor designs, which must be compact. This in turn limits how many components may be placed in a standard-compliant control device. This presents challenges in powering the components stored within the control device, because electronic components use low-voltage direct current (DC), but the three power pins pass through the current on the municipal line, meaning they carry alternating current (AC) at variable distribution voltages ranging from 110-480 volts AC. Thus, the components must be powered by an electrochemical cell, which produces DC power, a point-of-consumption energy sources such as a photovoltaic device or small wind turbine, or the AC power received via the municipal line must be converted to DC, and stepped down to a usable voltage.

Batteries and point-of-consumption solutions introduce additional difficulties. Batteries eventually expire and must be replaced, which requires servicing. Additionally, by the nature of its location, the control device is exposed to hostile environmental conditions, which can reduce battery life. Likewise, renewable solutions cannot reliably provide power in most deployment locations, requiring battery backups. Furthermore, such solutions add additional maintenance overhead. Accordingly, these solutions are expensive and duplicative, compared to the minimal power requirements of the internal components.

Likewise, using municipal power is difficult. For most of the last century, power has been supplied to cities using high voltage AC power lines, generally in the range of 138-765 kVAC, and then stepped down for industrial, commercial, and residential use, and converted to DC as necessary. This variability in voltage is provided across municipal power grids, and even within a power grid or street, is a result of various factors, such as consumer need and zoning. In any given area, distribution voltages can range between 110-480 VAC, with variances of +/−10%, resulting in a range of 90-528 VAC.

The practical consequence of these variances is that a multitude of control devices must be manufactured and stocked, one for each potential voltage. This imposes significant costs, such as stocking inventory, and tracking the voltage on any particular pole. For example, if a unit requires service or replacement, it can only be replaced by a unit adapted to convert the correct input voltage. If the service personnel are unsure of the voltage of a given pole, or accidentally use the wrong type of control device, the device may be damaged or simply not function at all.

The end result is that prior art solutions have been simplistic, and simply use a photocell to detect light and, if there is sufficient ambient illumination, cut power to the luminaire using the power supply pins in the standard. The dimming control circuits defined in the standard are not used because there is no way to power the components needed to use the dimming circuit lines via the receptacle interface.

SUMMARY OF THE INVENTION

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

A method of reducing bandwidth consumption in a municipal infrastructure comprising: providing a plurality of municipal light poles, each municipal light pole in the plurality having: a luminaire having a dimming receptacle disposed on an exterior surface thereof and a current operational state; and a wireless node operatively coupled to the luminaire via the dimming receptacle; wherein the wireless nodes of the plurality of municipal light poles form a local mesh network, and at least one of the wireless nodes comprises a gateway node; providing a server having a master state table containing data indicative of the current operational state of each of the luminaires, the server in communication with the at least one gateway node via a wide-area network; storing, at the at least one gateway node, a copy of the master state table received from the server; receiving, at the server, an instruction indicative of at least one luminaire of the plurality of municipal light poles, and a desired current operational state of the at least one luminaire; and determining, at the server, whether the master state table indicates that the current operational state of the at least one luminaire is the desired current operational state, and: if the determining results in a determination that the current operational state of the at least one luminaire is not the desired current operational state: updating, at the server, the master state table to indicate the desired current operational state for the at least one luminaire; transmitting the identifier for the at least one luminaire and the desired current operational state to the at least one gateway node; receiving, at the at least one gateway node, the identifier and the desired current operational state; updating, at the at least one gateway node, the state table copy to indicate the desired current operational state for the at least one luminaire; the at least one gateway node transmitting the identifier and the desired current operational state to other wireless nodes of the plurality of municipal light poles via the mesh network; based on the identifier, the wireless node for the at least one luminaire operating the at least one luminaire to change the current operational state of the at least one luminaire to the desired current operational state; and if the determining results in a determination that the current operational state of the at least one luminaire is the desired current operational state: not updating the state table in response to the instruction: not transmitting to the first wireless node in response to the instruction.

In an embodiment, the method further comprises: the wireless node for the at least one luminaire transmitting to the at least one gateway node via the mesh network an acknowledgment of the operating the at least one luminaire to change the current operational state of the at least one luminaire to the desired current operational state to first wireless node via the mesh network; the at least one gateway node updating the master state table copy to indicate the current operational state for the at least one luminaire is the desired current operational state for the at least one luminaire and the at least one gateway node transmitting the acknowledgment to the server; and at the server, receiving the acknowledgment and updating the master state table to indicate the current operational state for the at least one luminaire is the desired current operational state for the at least one luminaire.

In another embodiment, the method further comprises: providing an end-user computer; and before the receiving, at the server, an instruction indicative of at least one luminaire of the plurality of municipal light poles, and a desired current operational state of the at least one luminaire: receiving, at the end-user computer, the instruction; and the end-user computer transmitting the instruction to the server.

In another embodiment, the method further comprises: wherein the end-user computer is selected from the group consisting of: a desktop computer, a laptop computer, a tablet computer, a smart phone, a vehicular computer, and a wearable computer.

In another embodiment, the method further comprises: wherein the mesh network is one or more of the following: a municipal mesh network or a private mesh network.

In another embodiment, the method further comprises: wherein the server is one or more of the following: a municipal server or a private server.

In another embodiment, the method further comprises: wherein, for each luminaire in the plurality of municipal light poles, the operational state is one or more of the following: powered, unpowered, color temperature, intensity, hue, or voltage.

In another embodiment, the method further comprises: wherein each of the luminaires comprises a municipal luminaire adapted to illuminate a roadway, and each of the second luminaires comprises a flexible tube mounted on an arm of the light pole anterior to the luminaire.

In another embodiment, the method further comprises: wherein each of the wireless nodes comprises a radio transceiver, a controller, and a memory.

In another embodiment, the method further comprises: wherein at least some of the wireless nodes comprise gateway nodes in wireless communication with the server over a wide-area network.

In another embodiment, the method further comprises: wherein each of the at least some of the wireless nodes comprise gateway nodes in wireless communication with the server over a wide-area network.

In another embodiment, the method further comprises: further comprising: on a periodic basis and at a predetermined frequency, for each municipal light pole in the plurality of municipal light poles, the wireless node operating the luminaire to cause the current operational state of the luminaire to be the same as the current operational state indicated for the luminaire in the master state table copy.

In another embodiment, the method further comprises: on a periodic basis and at a predetermined frequency, for each gateway node in the at least one gateway nodes, receiving a current copy of the master state table from the server and causing the master state table copy to be the same as the received copy of the master state table.

In another embodiment, the method further comprises: a first municipal light pole in the providing a plurality of municipal light poles further comprising at least a first sensor operatively and communicatively coupled to the wireless node; the at least a first sensor generating data about the environment proximate to the municipal light pole; the wireless node receiving the generated data and transmitting, via the mesh network, the generated data to the at least one gateway node; and the at least one gateway node receiving the generated data via the mesh network and transmitting the generated data, via the wide-area network, to the server.

In another embodiment, the method further comprises: wherein the sensor is selected from the group consisting of: a parking sensor, a pedestrian sensor, a traffic sensor, an occupancy sensor, a light sensor, a noise sensor, a smoke sensor, an optical sensor, a camera, an air quality sensor, a pollutant sensor, a pollen sensor, a snow accumulation sensor, a weather sensor, a temperature sensor, a rain sensor, a humidity sensor, a barometer, a water level sensor, an earthquake sensor, an avalanche sensor, a seismic activity sensor, a wave sensor, a carbon dioxide sensor, a carbon monoxide sensor, a gas sensor, a radiological sensor, or an Internet-of-Things (IoT) sensor.

In another embodiment, the method further comprises: wherein the sensor receives end-user instructions transmitting to the server by an end-user by the server transmitting the instructions to the at least one gateway node and the at least one gateway node transmitting the instructions via the mesh network.

In another embodiment, the method further comprises: wherein each of the municipal light poles comprises: a municipal alternating current (AC) electric power line in electrical communication with the luminaire at a municipal distribution voltage; and a power converter receiving the electric power and converting the AC current to direct current (DC) at a device voltage, the device voltage being lower than the municipal voltage.

In another embodiment, the method further comprises: wherein the municipal distribution voltage is between about 110 and 480 volts AC and the device voltage is between about 0 and 10 volts DC.

In another embodiment, the method further comprises: wherein the power converter is enclosed within the wireless node.

DESCRIPTION OF THE PREFERRED EMBODIMENT(S)

Figure 1:
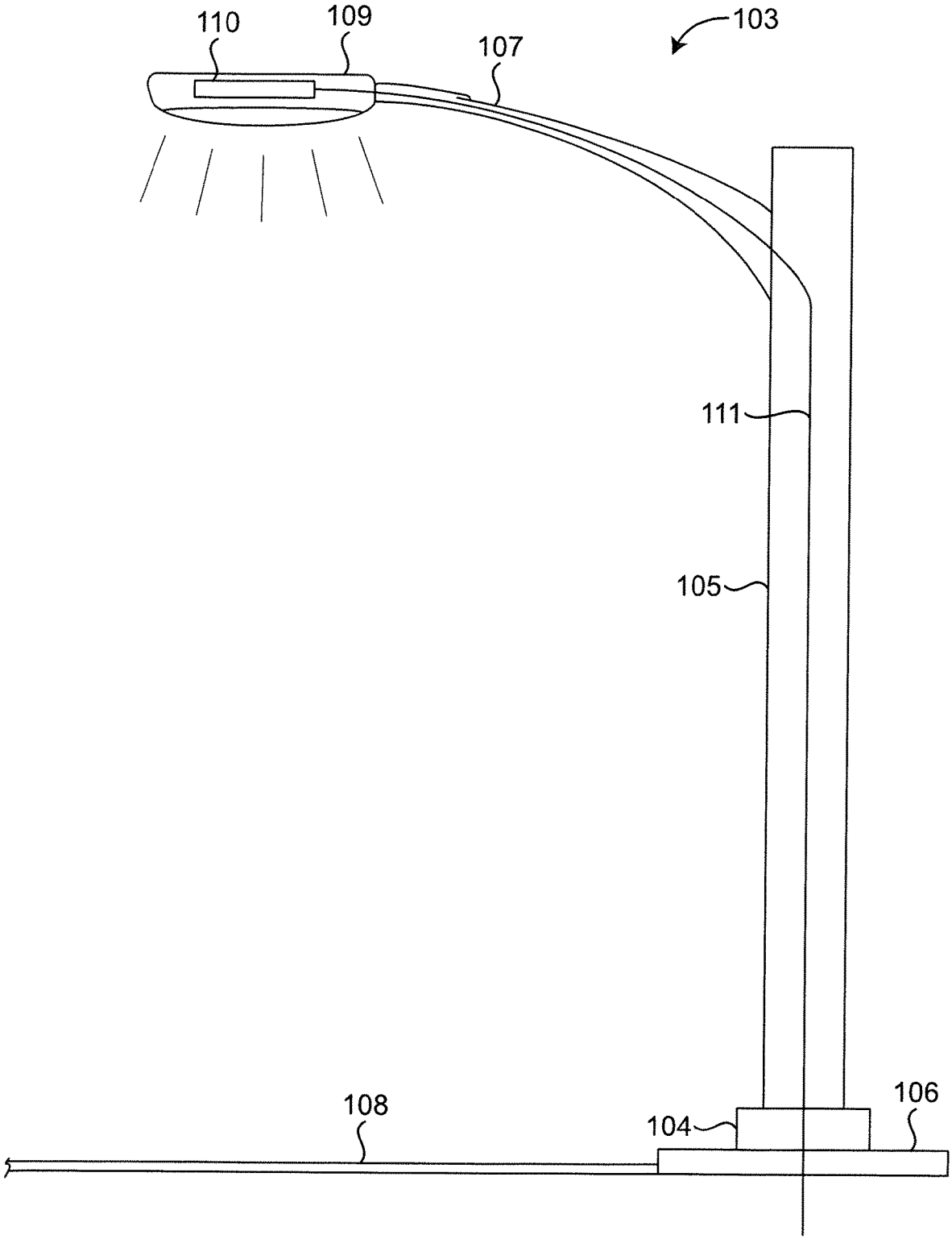
FIG. 1 (PRIOR ART)
FIG. 1 depicts an embodiment of a prior art municipal fixture.

The following detailed description and disclosure illustrates by way of example and not by way of limitation. This description will clearly enable one skilled in the art to make and use the disclosed systems and methods, and describes several embodiments, adaptations, variations, alternatives, and uses of the disclosed systems and methods. As various changes could be made in the above constructions without departing from the scope of the disclosures, it is intended that all matter contained in the description or shown in the accompanying drawings shall be interpreted as illustrative and not in a limiting sense.

Because of these and other problems in the art, described herein, among other things, are systems and methods for modifying a municipal fixture to affix endpoint devices, provide a power to such devices, and managing network traffic between and among such devices, including managing upstream transmission and efficiently propagating desired state changes through the network.

The systems and methods described herein generally use a plurality of mesh radio transmitters which are configured for peer-to-peer data exchange to propagate system state changes to one or more uplink gateways. The gateways may then aggregate this data and transmit it over a wide area network to a server or server farm for processing, analysis, and other use. That data may also be viewed in real time by user devices, and instructions and commands may also be relayed to the individual IoT devices in the mesh network via such user devices. These and other features are described herein.

Throughout this disclosure, the term "computer" describes hardware which generally implements functionality provided by digital computing technology, particularly computing functionality associated with microprocessors. The term "computer" is not intended to be limited to any specific type of computing device, but unless otherwise specified, it is intended to be inclusive of all computational devices including, but not limited to: processing devices, microprocessors, personal computers, desktop computers, laptop computers, workstations, terminals, servers, clients, portable computers, handheld computers, cell phones, mobile phones, smart phones, tablet computers, server farms, hardware appliances, minicomputers, mainframe computers, video game consoles, handheld video game products, and wearable computing devices including, but not limited to, eyewear, wristwear, pendants, fabrics, and clip-on devices.

As used herein, a "computer" is necessarily an abstraction of the functionality provided by a single computer device outfitted with the hardware and accessories typical of computers in a particular role. By way of example and not limitation, the term "computer" in reference to a laptop computer would be understood by one of ordinary skill in the art to include the functionality provided by pointer-based input devices, such as a mouse or track pad, whereas the term "computer" used in reference to an enterprise-class server would be understood by one of ordinary skill in the art to include the functionality provided by redundant systems, such as RAID drives and dual power supplies.

It is also understood to those of ordinary skill in the art that the functionality of a single computer may be distributed across a number of individual machines. This distribution may be functional, as where specific machines perform specific tasks; or, balanced, as where each machine is capable of performing most or all functions of any other machine and is assigned tasks based on its available resources at a point in time. Thus, the term "computer" as used herein, can refer to a single, standalone, self-contained device or to a plurality of machines working together or independently, including without limitation: a network server farm, "cloud" computing system, software-as-a-service, or other distributed or collaborative computer networks.

Those of ordinary skill in the art also appreciate that some devices that are not conventionally thought of as "computers" nevertheless exhibit the characteristics of a "computer" in certain contexts. Where such a device is performing the functions of a "computer" as described herein, the term "computer" includes such devices to that extent. Devices of this type include, but are not limited to: network hardware, print servers, file servers, NAS and SAN, load balancers, and any other hardware capable of interacting with the systems and methods described herein in the matter of a conventional "computer."

As will be appreciated by one skilled in the art, some aspects of the present disclosure may be embodied as a system, method or process, or computer program product. Accordingly, aspects of the present disclosure may take the form of an entirely hardware embodiment, an entirely software embodiment (including firmware, resident software, micro-code, etc.) or an embodiment combining software and hardware aspects that may all generally be referred to herein as a "circuit," "module," or "system." Furthermore, aspects of the present invention may take the form of a computer program product embodied in one or more computer readable media having computer readable program code embodied thereon.

Any combination of one or more computer readable media may be utilized. The computer readable medium may be a computer readable signal medium or a computer readable storage medium. Unless otherwise specified, a non-transitory medium is intended. A computer readable storage medium may be, for example, but is not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic , optical, or any suitable combination thereof. A computer readable signal medium may be any computer readable medium that is not a computer readable storage medium and that can communicate, propagate, or transport a program for use by or in connection with an instruction execution system, apparatus, or device.

Throughout this disclosure, the term "software" refers to code objects, program logic, command structures, data structures and definitions, source code, executable and/or binary files, machine code, object code, compiled libraries, implementations, algorithms, libraries, or any instruction or set of instructions capable of being executed by a computer processor, or capable of being converted into a form capable of being executed by a computer processor, including, without limitation, virtual processors, or by the use of run-time environments, virtual machines, and/or interpreters. Those of ordinary skill in the art recognize that software can be wired or embedded into hardware, including, without limitation, onto a microchip, and still be considered "software" within the meaning of this disclosure. For purposes of this disclosure, software includes, without limitation: instructions stored or storable in RAM, ROM, flash memory BIOS, CMOS, mother and daughter board circuitry, hardware controllers, USB controllers or hosts, peripheral devices and controllers, video cards, audio controllers, network cards, Bluetooth® and other wireless communication devices, virtual memory, storage devices and associated controllers, firmware, and device drivers. The systems and methods described herein are contemplated to use computers and computer software typically stored in a computer- or machine-readable storage medium or memory.

Program code embodied on a computer readable medium may be transmitted using any appropriate medium, including, but not limited to, wireless, wireline, optical fiber cable, RF, etc., or any suitable combination of the foregoing.

Throughout this disclosure, the term "network" generally refers to a voice, data, or other telecommunications network over which computers communicate with each other. The term "server" generally refers to a computer providing a service over a network, and a "client" generally refers to a computer accessing or using a service provided by a server over a network. Those having ordinary skill in the art will appreciate that the terms "server" and "client" may refer to hardware, software, and/or a combination of hardware and software, depending on context. Those having ordinary skill in the art will further appreciate that the terms "server" and "client" may refer to endpoints of a network communication or network connection including, but not necessarily limited to, a network socket connection. Those having ordinary skill in the art will further appreciate that a "server" may comprise a plurality of software and/or hardware servers delivering a service or set of services. Those having ordinary skill in the art will further appreciate that the term "host" may, in noun form, refer to an endpoint of a network communication or network (e.g., "a remote host"), or may, in verb form, refer to a server providing a service over a network ("hosts a website"), or an access point for a service over a network.

Throughout this disclosure, the term "real-time" refers to software operating within operational deadlines for a given event to commence or complete, or for a given module, software, or system to respond, and generally invokes that the response or performance time is, in ordinary user perception and considered the technological context, effectively generally cotemporaneous with a reference event. Those of ordinary skill in the art understand that "real time" does not literally mean the system processes input and/or responds instantaneously, but rather that the system processes and/or responds rapidly enough that the processing or response time is within the general human perception of the passage of real time in the operational context of the program. Those of ordinary skill in the art understand that, where the operational context is a graphical user interface, "real time" normally implies a response time of no more than one second of actual time, with milliseconds or microseconds being preferable. However, those of ordinary skill in the art also understand that, under other operational contexts, a system operating in "real time" may exhibit delays longer than one second, particularly where network operations are involved.

Throughout this disclosure, the term "municipal infrastructure fixture" refers to light, power, and telecommunications poles and appurtenances thereto, which are installed and used by or on behalf of cities and/or utilities and carriers to deliver utilities and services to the public. Such poles are generally installed in a row along a roadway for related purposes, such as street lighting, power lines, and/or telecommunication cables. As further set forth in this disclosure, the fixtures are generally close enough together that a collection of short-range transmitters installed on them can form a mesh network.

Figure 2:
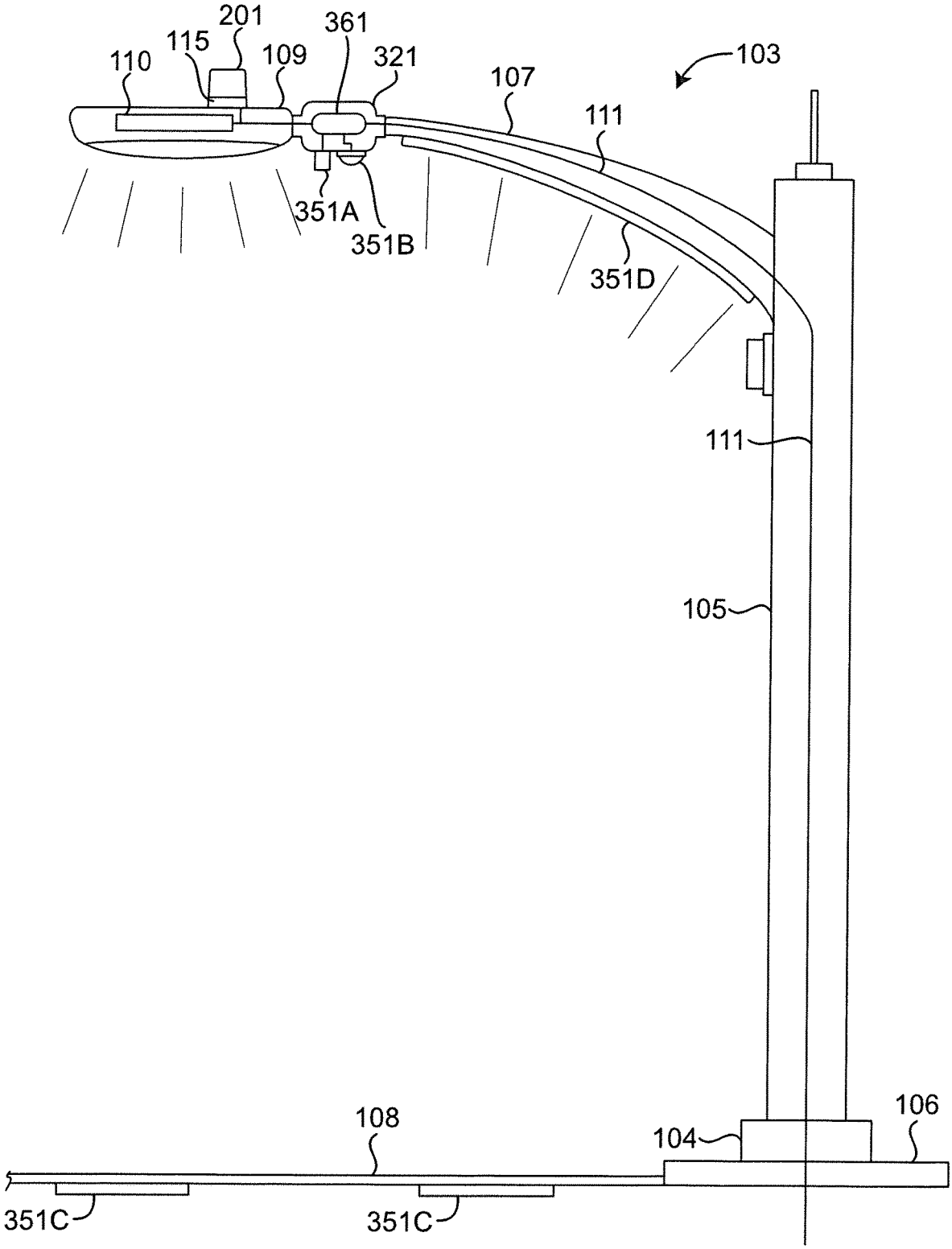
FIG. 2 depicts an embodiment of a municipal fixture modified with smart grid components as described herein.
Figure 3:
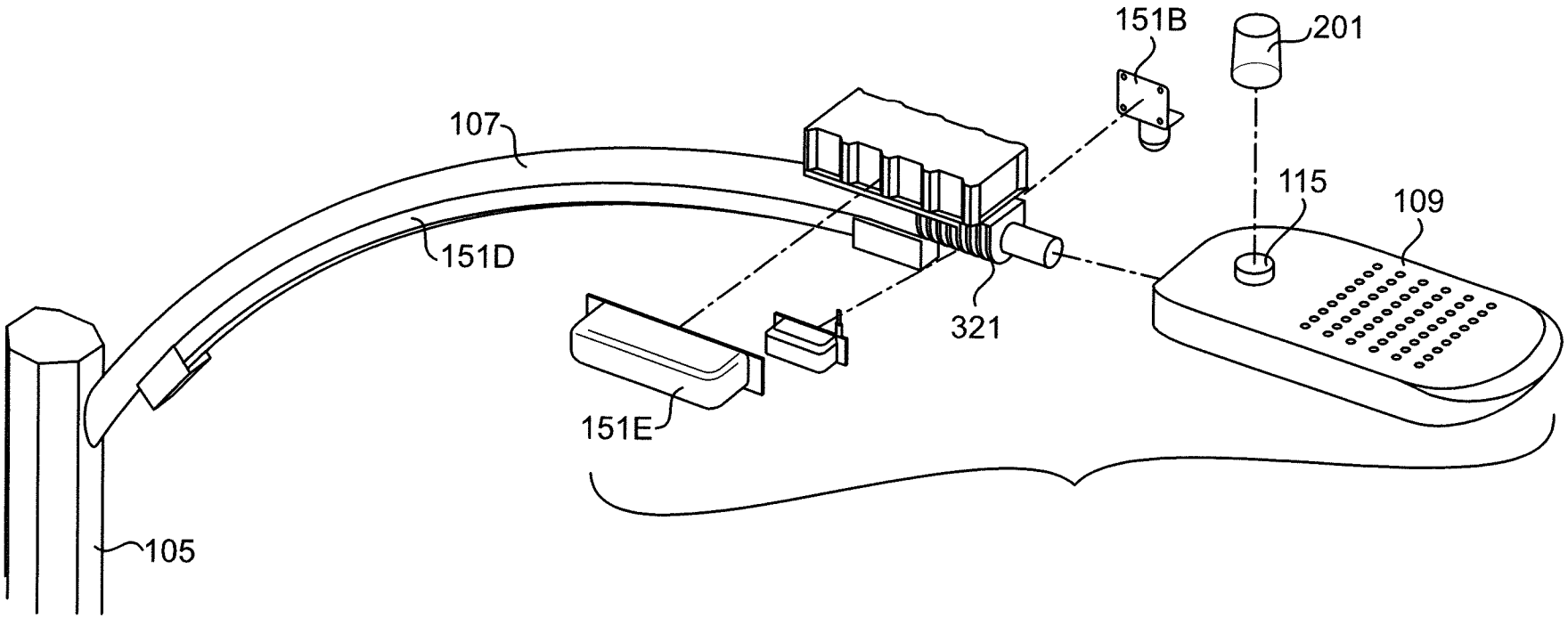
FIG. 3 depicts an alternative embodiment of a municipal fixture modified with smart grid components as described herein.

FIG. 2 and FIG. 3 depict embodiments of a municipal fixture (103) having various devices and systems described herein. The depicted municipal fixture (103) is a municipal street light (103) similar to that depicted in FIG. 1. The depicted municipal fixture (103) comprises a base (104) attached to a sidewalk (106) adjacent to a street (108). However, the fixture may be installed in other locations, such as (but not necessarily limited to) along pedestrian walkways, hiking or biking paths, in a park or parking lot, and the like. A vertical pole (105) rises vertically above the street (108) to disperse illumination, provide clearance for traffic, and to reduce tampering. A light arm (107) extends laterally from the pole (105) over the street (108). The depicted light has been modified from that shown in FIG. 1, via an enclosure (321) disposed between the light arm (107) and the light head (109).

One aspect of the depicted embodiment is the use of the enclosure (321) to modify the existing municipal fixture (103) to protect and enclose certain components. Examples of such an enclosure (321) are described in U.S. patent application Ser. No. 15/656,675, filed Jul. 21, 2017, the entire disclosure of which is incorporated herein by reference, and related cases, which describe a hull enclosure (321) for use with a cobra arm municipal lighting fixture. Another example of such an enclosure (321) is described in U.S. Prov. Pat. App. Ser. No. 62/688,194, filed Jun. 21, 2018, the entire disclosure of which is incorporated herein by reference, and which describes a universal mounting system for use with a municipal fixture, such as the municipal fixture (103) described herein.

The depicted light head (109) is further outfitted with a luminaire control device (201), which in turn includes a universal power supply (211). The enclosure (321) may in turn comprise a power supply (361). In the depicted embodiment, a plurality of endpoint devices (351A), (351B), (351C), and (351D) are shown deployed in the proximity of the luminaire control device (201). One such depicted endpoint device (351A) is a pedestrian/motion sensor. Another such depicted endpoint device (351B) is a traffic camera. Another such depicted endpoint device (351C) is a system for detecting the presence of a vehicle, shown disposed beneath the surface of the street (108). The fourth depicted endpoint device (351D) is a configurable bar light (351D). These and other endpoint devices may be referred to collectively herein by the general term "endpoint device" (351) for simplicity. These and other components of the municipal fixture (103) shown in FIG. 2 are described in further detail elsewhere herein.

As can be seen in the depicted embodiment of FIG. 2, the power line (111) may supply power to the power supply (361) within the enclosure (321), which in turn may power one or more endpoint devices (351A) and (351B). The power supply may also supply power to the source of illumination (110) and/or to the luminaire control device (201). At the luminaire control device (201), power may be converted to direct current by a universal power supply (211). The universal power supply (211) may be used to accept as a power input the voltage and current available on the power line (111) and convert that power input to one or more standard outputs usable by the luminaire control device (201). Also, the enclosure (321) may include a power supply or power converter. The depicted luminaire control device (201) may comprise a network communication device (225) used to collect and exchange data from endpoint devices, generally using a peer-to-peer protocol in a mesh network.

Figure 4:
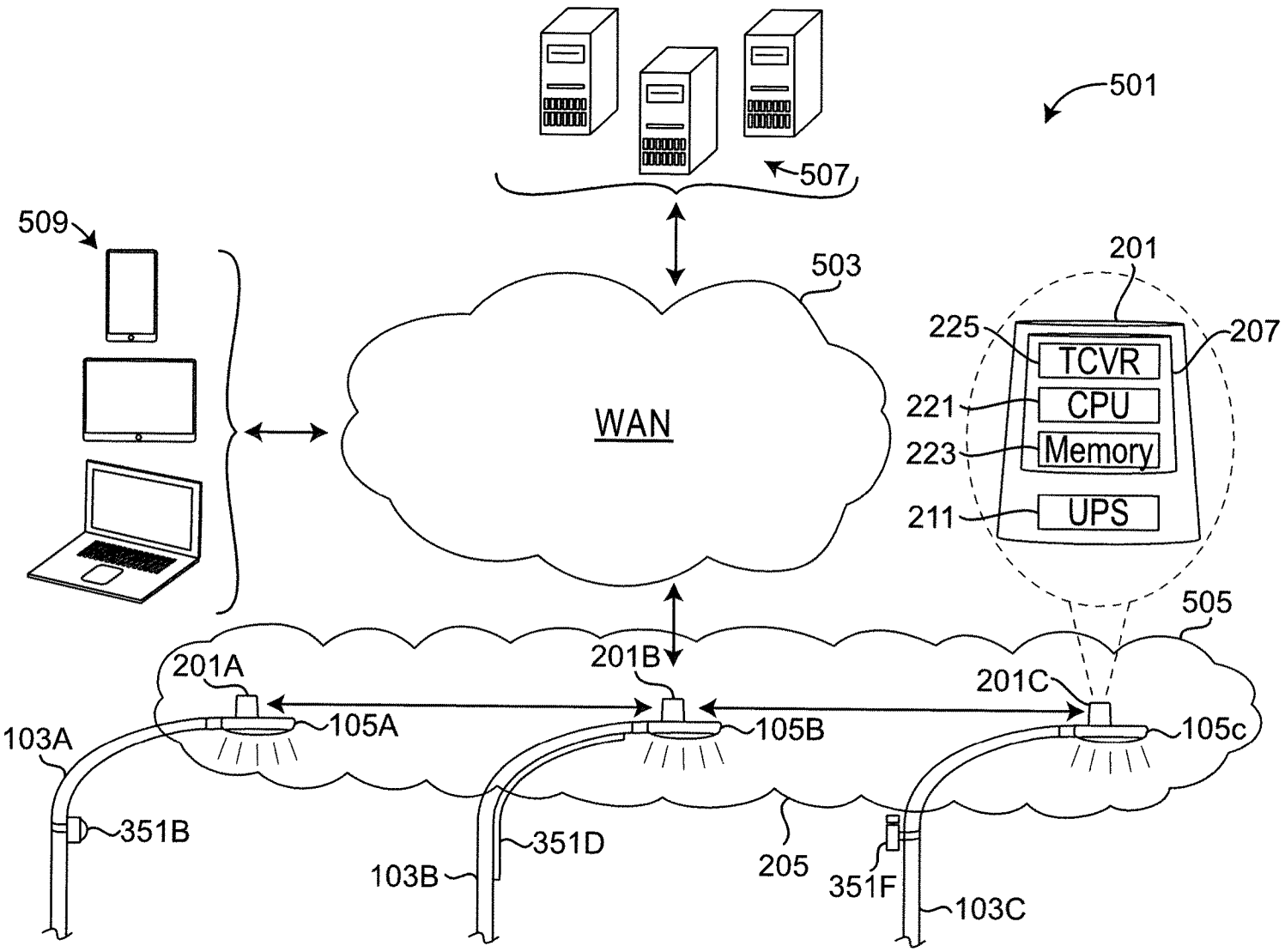
FIG. 4 depicts a system for aggregating signals in a mesh network as described herein.

FIG. 4 depicts an embodiment of a system as described herein. In the depicted embodiment of FIG. 4, the system (501) comprises a mesh network (505) formed by a plurality of luminaire control devices (201), sometimes also referred to herein as nodes (201A), (201B), and (201C) in wireless communication. The term "mesh network" will be understood as referring to a local network topology in which network infrastructure devices and nodes connect non-hierarchically to other nodes and cooperate to route data efficiently from/to clients. Mesh networks are often characterized by dynamic self-organization and self-configuration. In an alternative embodiment, a conventional network topology may be used, but a mesh network is preferred.

In the depicted embodiment of FIG. 4, the mesh network (505) is formed by three nodes (201A), (201B), and (201C), but this is exemplary only and there may be fewer or (in most cases) more nodes in any given mesh network (505). For sake of simplicity, the plurality of nodes will be referred to herein collectively as nodes (201) unless a specific node is described. The depicted nodes (201) communicate with each other in the local mesh network (505), and one such node (201B) is designated as a gateway node (201B) and also communicates to a wide area network (503). The depicted wide area network (503) is the public Internet, but this is exemplary only. In an alternative embodiment, the wide area network (503) may be a private or virtual private network, or another type of telecommunications network. Although the nodes (201) are capable of, and may, communicate with one another, the nodes (201) primarily communicate with one or more designated gateway nodes (201B). Although the gateway nodes (201B) are also capable of communicating with one another, in the preferred embodiment, they do not, and instead, they communicate with a server (507) as described elsewhere herein. In alternative embodiments, a different communication protocol may be implemented via the nodes (201) and gateways (201B), depending upon whether the transceivers of the nodes (201) are capable of mesh network communication, or if an alternative protocol is instead implemented.

The depicted gateway node (201B) communicates over the wide area network (503) with a server computer (507). Conceptually, it is anticipated that the server computer (507) is primarily responsible for maintaining an authoritative state diagram of the current status of all managed endpoint devices (351), and the gateway nodes (201B) and/or other nodes (201) are responsible for local handling of individual protocols and device commands for managing and altering the state and functions of the various endpoint devices (351). Shifting this function to the gateway nodes (201B) or other nodes (201) has the additional advantage of executing operational functionality proximate to the nodes (201), which achieves faster reaction time.

The depicted gateway node (201B) may also communicate with one or more client devices (509). However, in the typical embodiment, client devices (509) communicate with the server (507) over the WAN (503), and the server (507) communicates with one or more gateway nodes (201B) in the mesh network (505). Thus, the mesh network (505) is local only and topologically separated from the WAN (503) by the gateway node (201B).

The depicted nodes (201) of FIG. 4 are preferably not off-the-shelf network hardware, but rather customized devices. The depicted nodes (201) may comprise a radio transceiver (225), a processor or controller (221) operatively coupled to the radio transceiver (225), and a memory (223) operatively coupled to the processor (221). The memory (223) generally contains program instructions, scripts, and local storage. The program instructions are executed by the processor (221) to operate the transceiver (225). A node (201) may comprise one or more additional components, inputs, and outputs, including, but not limited to, a power supply, as further described elsewhere herein.

In use as the nodes (201) of a smart city embodiment, each of the depicted nodes (201) is disposed at a corresponding municipal fixture (103A), (103B), and (103C). For sake of simplicity, the municipal fixtures will be referred to herein collectively as fixtures (103) unless a specific fixture (103A), (103B), or (103C) is described. The depicted fixtures (103) are street lighting poles, but this is exemplary only and alternative fixtures may be used in an embodiment. Such alternatives may include, but are not limited to, signage, buildings and structures, bridges and overpasses, traffic control signals, electrical poles and fixtures, telecommunications poles and fixtures, railings and handrails, awnings, bus and train stops or stations, trees and plants, benches and trash receptacles, or any other municipal fixture that would not ordinarily be significantly moved or relocated. In an alternative embodiment, one or more nodes (201) may be affixed to a vehicle or other movable object, such as city vehicles or equipment (e.g., to track where they are, or how they are used), or in transit vehicles (e.g., to track movement and utilization). In a still further embodiment, a node (201) may be affixed to a microtransit vehicle, such as a motorized scooter or bicycle.

In the depicted embodiment, a municipal light (103) is modified by a housing adapter or enclosure (321), including a power supply (361). The depicted power supply (361) is configured to provide electrical power to other components from the power line (111). The municipal lights (103) may be thus modified by attaching the enclosure (321) to the end of the light arm (107), installing a power supply (361) in the housing (321), and attaching endpoint devices (351) to the modular power supply enclosure (321).

It will be clear that in an alternative embodiment using another type of fixture, the particular configurations of these structures may differ. For example, if a node (201) is installed on a traffic control light, a different type of adapter may be necessary to provide an attaching point for the node (201). Similarly, if a node (201) is installed on a fixture without a power source, then the configuration of the power supply (361) may differ. For example, a chemical cell or renewable power source may be required.

In the depicted embodiment of FIG. 4, at least one of the municipal lights (103) has affixed thereto an endpoint device (351B), (351D), or (351F). The endpoint device (351) is typically an input and/or output device in the broadest sense, providing either communication to those present nearby or collecting input from the locality. By way of example and not limitation, the depicted endpoint device on a first municipal light (103A) is a traffic camera (351B). The depicted endpoint device (351D) on a second municipal fixture (103B) is a bar light (351D). The depicted endpoint device (351F) on a third municipal fixture (103C) is a rain sensor (351F). These endpoint devices may themselves contain network hardware and communicate in the mesh network (505) by wireless transmission, or may be wired to the node (201) associated with the municipal fixture (103) and provide data to the node (201), which then provides the data on the mesh network (505). In either event, the endpoint device is conceptually similar to an IoT device.

An IoT device generally is a device or product whose primary purpose or function is generally unrelated to network communications (e.g., a traditional "dumb" device), but which is enabled for network communication regardless, in order to share and exchange data and information for remote monitoring, access, and control. The depicted endpoint devices (351) may be IoT devices themselves, but an advantage to the present systems and methods is that it does not matter whether a given endpoint device (351) is IoT-ready, because the device can be connected to the corresponding node (201) on the municipal fixture (103) via the housing (321), communicate with the corresponding node (201), and use the transceiver (225) of the corresponding node (201) for IoT functionality.

A non-limiting example may illustrate the point. In the depicted embodiment of FIG. 4, a configurable bar light (351D) is affixed to a fixture (103B). This light (351D) may be an out-of-the-box, off-the-shelf light (351D) with no network connectivity, though its hue, intensity, and other characteristics may be altered or changed. The light (351D) may be powered by the power supply (361) or a power supply (211) of an associated node (201B), and connected to the associated node (201B) via the enclosure (321). Thus, whether or not the light (351D) is an IoT device, it can be controlled by the node (201B). The node (201B) is part of the mesh network (505), and the mesh network (505) has access to a WAN (503) through a gateway node (201B). In this example, the gateway node (201B) is also the corresponding node (201B) to the endpoint device (351D). Thus, the node (201B) can relay instructions and data pertaining to the endpoint device (351D) to and from servers (507), client devices (509), or other nodes (201) via the mesh network (505) alone, via the WAN (503) alone, or, in most instances, a combination of the two. For example, the corresponding node (201B) happens to be the gateway node (201B) in the depicted embodiment and so it can directly communicate with the WAN (503) for data exchange with the depicted server (507) and/or client devices (509). The corresponding node (201B) can also communicate over the mesh network (505) with the other two depicted nodes (201A) and (201C). Alternatively, for an input endpoint device (351), this data flow is effectively reversed, from the device (351) to the gateway (201B) to the server computer (507).

In another non-limiting example, endpoint device (351B) is a traffic camera, which again may be an out-of-the-box, off-the-shelf camera, which may or may not have network connectivity. Whether or not the camera (351B) is an IoT device, it can be controlled by the node (201A). The node (201A) is again part of the mesh network (505), which has access to a WAN (503) through the gateway node (201A). In this example, the gateway node (201B) is not the corresponding node (201A). Thus, in this instance, the camera (351B) can send and receive data with its corresponding node (201A), which communicates over the mesh network (505) with gateway node (201B), which can then communicate over the WAN (503) with servers (507), client devices (509), and other machines on the WAN (503).

Also, the node (201A) can communicate directly with another node (201C), or indirectly by routing through the gateway node (201B). Although only three nodes are shown, it will be understood that the corresponding node (201A) could be an edge node in the mesh network (505), and may be outside the transmission range of the gateway node (201B). In this case, an edge node (201A) could communicate with other nodes in range, and rely on those nodes to route communications to and from the gateway node (201B). This allows for a large number of nodes in the mesh network (505) to spread across a wide geographic region, including in an urban area with high-rises that may block or inhibit wireless communications, and to route communications around such obstacles.

The endpoint devices shown in FIG. 4 are non-limiting and exemplary, and a variety of different devices could be used in an embodiment. Examples include, but are not limited to, parking monitoring devices (e.g., sensors to monitor whether a parking space is occupied, such as magnets, optical sensors, proximity sensors, etc.), pedestrian sensors, occupancy sensors, structural sensors (e.g., devices which monitor vibrations and material conditions in buildings and infrastructure), bridge sensors, noise sensors, light sensors, smartphone detection, cameras, traffic monitoring and sensors, street lighting, waste management, fire sensors, smoke detectors, air pollutant sensors, pollen sensors, snow accumulation sensors, weather sensors, rain sensors, water level sensors, earthquake sensors, landslide and avalanche sensors, environmental sensors, carbon dioxide sensors, water quality and/or purity sensors, chemical sensors (e.g., to detect air or water pollution or leakage), water flow sensors (e.g., to detect blockages or rubbish in waterways), light sensors, digital banners, visibility distance sensors, sea level sensor, wave and tidal sensors, water main sensors, water pressure or speed sensors, hazardous or explosive gas or material sensors, radiological sensors, optical and infrared cameras, smart trash bin sensors, and so forth.

In the depicted embodiment, the plurality of nodes (201) communicates commands associated with the endpoint devices (351) over the mesh network (505) to one or more gateway nodes (201B). Each gateway node (201B) may then communicate this and other data with a server (507) over the WAN (503). The gateway node (201B) may also receive instructions over the WAN (503), from a server (507), from a client device (509), or from another source. The instructions generally comprise requests for information or data pertaining to one or more endpoint devices (351), or commends to control one or more endpoint devices (351).

The systems and methods described here may be used in an embodiment to propagate external instructions through the mesh network (505). This may be done by a user of a client device (509) providing instructions to the server (507), which then relays those instructions over the WAN (503) to one or more gateway nodes (201B). The gateway node(s) (201B) then relay(s) instructions to all other nodes (201A) and (201C) in the mesh network (505).

This may be further understood through a non-limiting illustrative example. Suppose that the municipal fixtures (103) are municipal street lights and that each light is equipped with a configurable bar light device (351D). The city in question has multiple sports teams or colleges with different team colors and desires for the bar lights (351D) to be the color of one specific team on days when that team is playing a game (e.g., red), and to be the color of a different team on days when that team is playing (e.g., blue). On days when no team is playing, the city wishes for the lights (351D) to be white. Rather than physically visit each municipal fixture (103) to adjust the color, the systems of FIG. 4 may be used to provide instructions.

A user, generally a person associated with the city or a relevant department thereof (e.g., streets, tourism, sports commission, etc.) will use an authorized client device (509) to connect to a server (507). Typically, the authorized client device (509) is a computer running a web browser or other web interface to connect to the server (507). The server is in communication with one or more gateway nodes (201B) in the mesh network (505) formed by the nodes (201) associated with each bar light (351D). The user provides instructions to the client device (509) via a user interface to change the light shade to blue. This may be done using any appropriate interface, such as a color wheel, manually providing red-blue-green (RBG) values or other color codes or values, and so forth. The client (509) then communicates these instructions to the server (507) over the WAN (503). The server (507) then communicates these instructions to the applicable gateway node(s) (201B). The gateway node(s) (201B) then use the mesh network (505) protocol to distribute the instructions across the mesh network (505) to the other nodes (201). All nodes (201), including the gateway node(s) (201B), then operate the connected light bar (351D) to change its color to blue as instructed.

It will be clear that security procedures and protections are needed. For example, if the communication protocol for the mesh network (505) is known, an unauthorized third party could use a wireless device to spoof an instruction to one or more nodes (201), and thus provide unauthorized instructions to an associated endpoint device (351). Similarly, an unauthorized third party could spoof a device (351), node (201), or gateway (201B), and provide false or unauthorized data to the server (507). To inhibit such tampering, the mesh network (505) may use a data exchange protocol encrypted via a private key, as well as asymmetric cryptographic key algorithms for device and gateway identity validation. Similarly, the gateway (201B) may use an encrypted communications technique, such as a secure sockets layer, virtual private network, or other secure networking protocol.

Additionally, and as further described elsewhere herein, a "snapshot" of the system state may be stored and used to periodically update endpoint devices (351). For example, the server (507) and/or one or more gateway nodes (201B) may maintain a stored copy of the desired current system state, based on the most recently received user instructions. The gateway (201B) may then periodically "check in" with the nodes (201) to confirm that the associated endpoint devices (351) have the correct settings and, if not, instruct the node (201) to configure the device (351) with the correct settings. The frequency of these "check-ins" may vary by endpoint device (351) type. For example, where the endpoint device (351) is a light bar, the consequences of an improper setting are generally not severe (a light may be off or have the wrong color), and it is less urgent to check in frequently. However, where the endpoint device (351) is a security or traffic camera, the frequency may be greater to ensure that the camera is properly configured, focused, and oriented to monitor the area. Thus, even if an unauthorized third party were to break into the system and provide spoofed instructions to a device, the error would be corrected in due course because the unauthorized third party cannot access or change the stored system state data, which is used to correct endpoint devices (351) with errant settings.

In an embodiment, methods for detecting errant behavior may comprise the use of acknowledgements. Such acknowledgements may take the form of the current state accompanied by a checksum, which is sent to one or more gateways (201B). Each such gateway (201B) has data concerning whether a particular command (e.g., instructing the settings of an endpoint device (351)) was successful. In the event that an endpoint device (351) received a command from an unauthorized or malicious external source, the endpoint device (351) would be programmed via the communications protocol to report the commanded state change from that source to its designated gateway (201B) in the form of an acknowledgement of the command. However, the gateway (201B) would have knowledge that it issued no such command, and could thus verify that the requested change was not actually requested via the system, and instruct the errant device to correct its state back to the stored state tracked by the gateway (201B) or the server (507). A checksum may be utilized to quickly assess whether the state is correct. That is, a checksum may be calculated to be representative of the intended or current device state. After the application of a delta (discussed in more detail elsewhere herein), a new checksum will be calculated and compared to the prior checksum. If they differ, then the system knows that a requested change was missed or an unauthorized change was executed, and resynchronize the system by transmitting a full copy of the device state to all nodes (201B), which can then provide appropriate command instructions to the endpoint devices (351).

As will be understood by a person of ordinary skill, the server (507) may be a single server, but it is more common for multiple servers to coordinate or collaborate to respond to requests to ensure timely responses. These multiple servers function as a single logical server (507), and the particular server selected to handle any one request may be determined using any number of techniques, such as by use of a load balancer.

To improve efficiency and minimize network bandwidth utilization, in an embodiment, the communications protocol in the mesh network (505), and/or between the gateway nodes (201B) and server (507), and/or among multiple server instances (507) forming a logical server, may operate on a "delta" basis. That is, when an instruction is received to alter the system state, only the deltas need be transmitted. By way of example and not limitation, if an instruction is received to change light bars to blue, but make no changes to intensity, there is no need to relay data about intensity, and only the delta between the current state and the desired state need to be communicated. This reduces the transmission of superfluous data, increases response time, and reduces bandwidth consumption.

Additionally, in an embodiment, endpoint devices (351) are treated as an abstraction and each type of endpoint device (351) has an associated format of expected data that may be sent to or received from the device. For example, a light bar type may have expected RGB and intensity values, but no orientation data. Thus, if an instruction is received for a light bar device that includes orientation data, the instruction can be quickly rejected and not propagated through the system, because it is formatted incorrectly for the device type. This is typically done at the server (507) but could also be done elsewhere in the system to prevent improper data from being unnecessarily transmitted, such as at the gateway node (201B), client (509), or any other nodes (201). The device type data format facilitates the data delta system described herein to operate efficiently by facilitating the elements of the system removing redundant data and communication with other elements of the system which already have the same information. In an embodiment, this may be performed at essentially each step of the data flow. Thus, if incorrect data is identified, it can be used to attempt to correct the system state and resolve conflicting deltas. Further, in an embodiment, it can be used as a flag for possible intrusion detection or attempted instruction by identifying endpoint device (351) behaviors or data values which are inconsistent with the expected behaviors and values based on the stored system state in the master record.

The overall framework for this system functions as a communication library for connecting devices. That is, the server (507) and gateways (201B) are programmed with a cohesive communication framework which tracks the system state and provides communications as necessary through the mesh network (505) to set devices to the desired state, or acquire desired data, and to do so in a device-agnostic fashion. This is done by abstracting each device in memory as a collection of data and states. When a new endpoint device (351) is desired to be added to the system, the endpoint device (351) itself may have its microcontroller or other programming modified to include a communications library for interoperating with the systems and methods described herein. Likewise, the communications library implemented via the server (507) and the gateways (201B) may also be modified to recognize the new type of endpoint device (351) throughout the system. However, because the communications layer is uniform, the operation of the system does not require further modification to accommodate new types of endpoint devices (351).

In an embodiment, the systems could be used to coordinate a performance among a plurality of lights. For example, a series of light poles (103) on a block or street could each be outfitted with a multi-color light tube controlled by a luminaire control device (201) described herein. A sequence of illumination instructions could be programmed so as to cause each luminaire (110) (or a second luminaire (117), light bar, or other device) to illuminate in a sequence and timing to present an image when viewed from a given perspective or angle. By way of example and not limitation, the luminaires (110) could present the impression of a national flag, such as the U.S. flag. Each luminaire (110) could also be operated to animate the flag, such as to simulate a "waving" effect. The luminaires (11) could also be coordinated to music so as to present a multimedia presentation.

Also described herein is a luminaire control device for use with a municipal light pole. The device is plugged into a standard dimming receptacle and includes a universal power supply for converting AC power received in any of the common municipal distribution voltages to a uniform DC output usable by small electronic components of an accompanying control system. The universal power supply and control system are configured to fit within the form factor required by applicable standards. The control system includes program logic to control the luminaire by sending control signals via the dimming receptacle. These signals may be sent using one, two, or more control channels as defined by the standard, and may control a single luminaire or multiple luminaires via the different channels. The device may further include a wireless transceiver to facilitate remote access and control of the light, allowing a municipal light pole to be retrofitted as an IoT device.

Figure 5:
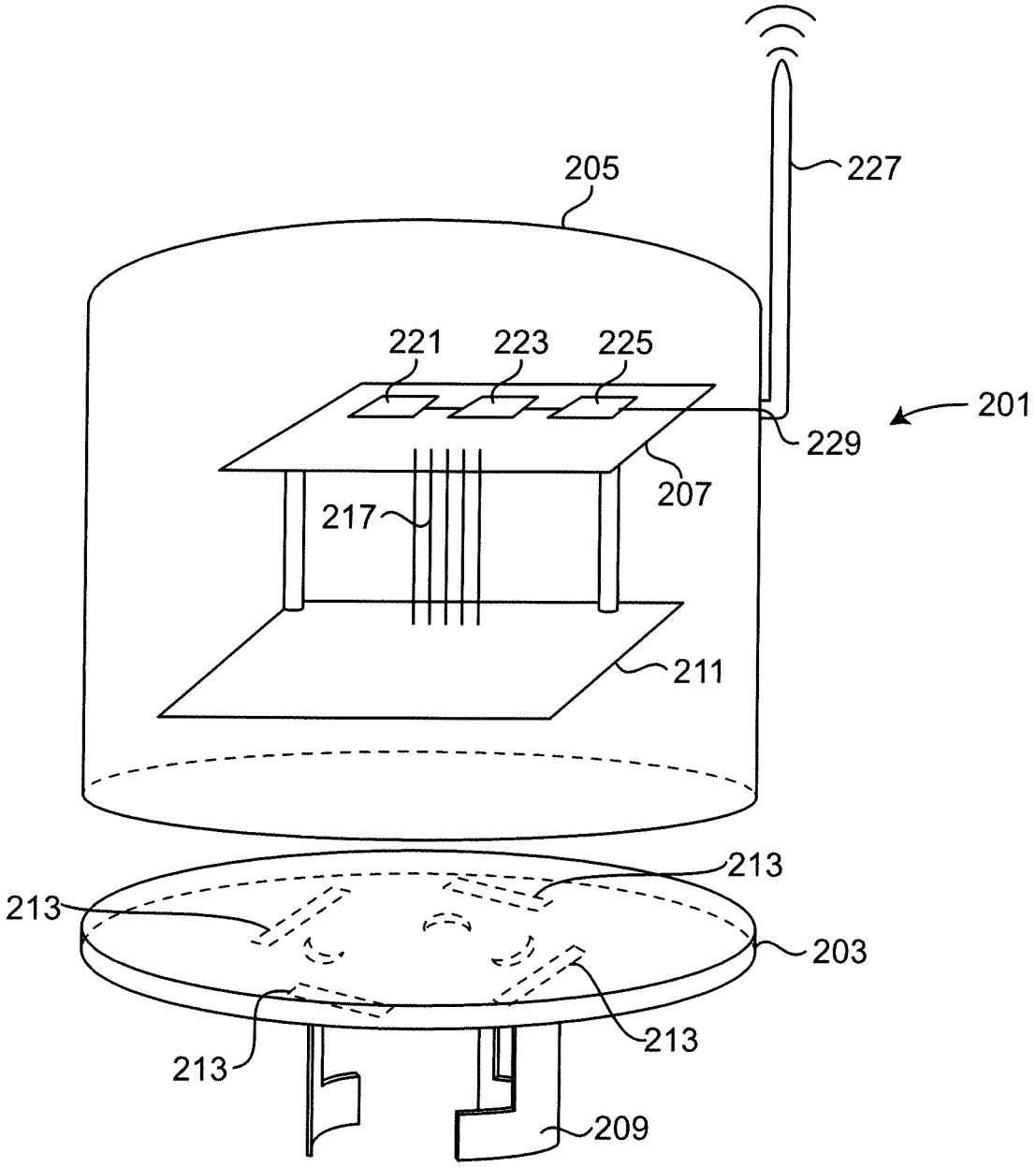
FIG. 5 provides an exploded diagram of an embodiment of a luminaire control device including a universal power supply as described herein.

Described herein, among other things, is a luminaire control device (201) including a universal power supply (211) and control system for use on a municipal infrastructure pole (103). FIG. 5 depicts a basic diagram of a device (201) as described herein. At a high level of generality, the luminaire control device (201) depicted in FIG. 5 can be thought of as having three main components: a housing (203) and (205), a power supply (211), and a control system (207). When the device (201) is further outfitted with a wireless communication system as part of a network of similar devices in a deployment, it may sometimes be referred to in shorthand as a "node" or "beacon."

The depicted housing comprises a base (203) and an enclosure (205) adapted to plug into a dimming receptacle (115) and enclose a power supply (211) and control system (207). The depicted control system (207) is adapted to control one or more luminaires (110), and the depicted power supply (211) is adapted to receive municipal electrical power in any of the commonly provided voltage ranges and convert that power into a uniform DC output suitable to power the components of the control system (207). Both of these elements (211) and (207) are adapted and arranged so as to fit within the enclosure (205), which is in turn adapted to the form factor of the base (203), and are further described elsewhere herein.

The form factor of the housing elements (203) and (205) may be defined or limited by the specifications of an applicable standard. For purposes of the exemplary embodiments described herein, that standard is ANSI C136.41. In an embodiment using the ANSI C136.41 standard, there may be 3-pin (power only), 5-pin (3 power pins plus one 2-pin dimming circuit), and 7-pin configurations (3 power pins and two 2-pin dimming circuits). In an alternative embodiment, the base (203) or other elements may comport with different standards or requirements as may be needed for the particular embodiment.

The depicted base (203) is a generally circular element made from a rugged, weather-resistant material to extend operational life and provide a suitable surface for supporting other elements. Generally, the base is sized and shaped to comport with the applicable standard for receptacles or sockets on a municipal light. As described elsewhere herein, the depicted base (203) is sized and shaped for use with a receptacle in compliance with ANSI C136.41.

The depicted enclosure (205) is a roughly cylindrical dome sized and shaped to accommodate the interior components of the device (201) described herein. The enclosure (205) has an open bottom end adapted to mate with the base (203) so as to form a sealed connection. The sealed connection should inhibit or prevent moisture penetration. Because the device (201) will ordinarily by used outdoors on a street light, it is desirable to endure outdoor weather conditions in most climates. The enclosure (205) should be manufactured from a rugged, water-resistant or waterproof material which can withstand liquid and solid precipitation, high winds, impacts from debris, and so forth. The enclosure (205) may be opaque, transparent, or translucent. A generally cylindrical enclosure (205) is shown but other sizes, shapes, and configurations of enclosures (205) are possible, including but not limited to enclosures (205) which have an orthogonal or prism configuration.

The particular configuration will generally depend on the shape of the base (203) to which the enclosure (205) attaches and the size and shape of the internal components. In certain embodiments, the enclosure (205) may further comprise one or more openings or apertures to allow some or all of the internal components to be disposed external to the enclosure (205). By way of example and not limitation, if an internal component is a wireless communication apparatus which includes an antenna (227), it may be desirable to dispose the antenna outside of the enclosure (205) for greater range. Thus, a water-resistant or watertight opening (229) in the enclosure (205) may be provided for this purpose.

In the depicted embodiment of FIG. 5, the base (203) has seven conductive elements to establish an electrical connection via the receptacle (115). These comprise three power transmission connections in the form of prongs (209) disposed in a circular twist-lock arrangement extending generally perpendicularly from the bottom of the base (203), and four functional inputs in the form of spring contacts (213). The depicted prongs (209) are sized, shaped, and arranged for plugging into the dimming receptacle (115) and provide a current path for electrical power (i.e., AC current) from the municipal power line (111) in the pole (105) to be provided to the power supply (211) as described elsewhere herein.

The particular size, shape, and number of prongs (209) may vary from embodiment to embodiment and will depend upon the particular configuration of the dimming receptacle (115) for which the device (201) is designed to interoperate. Generally, the prongs (209) comprise two hot lines and a neutral line and are electrically connected to the power supply (211).

The four depicted spring contacts (213) are for central circuits, or dimming pins, and are disposed in the positions on the bottom of the base (203) specified in the applicable standard. This allows the depicted device (201) to be used in a standard receptacle (115) to, for example, control light intensity, reduce power consumption, or perform other functions as described elsewhere herein. The contacts (213) are generally electrically connected to components of the control system (207). The depicted four dimming inputs (213) comprise various dimming command lines as defined by applicable standards. In an embodiment, the Digital Addressable Lighting Interface (DALI) standard may be used. These inputs generally do not connect directly to the power supply (211), but rather pass through to the control system (207) and are controlled by components disposed thereon.

Figure 10:
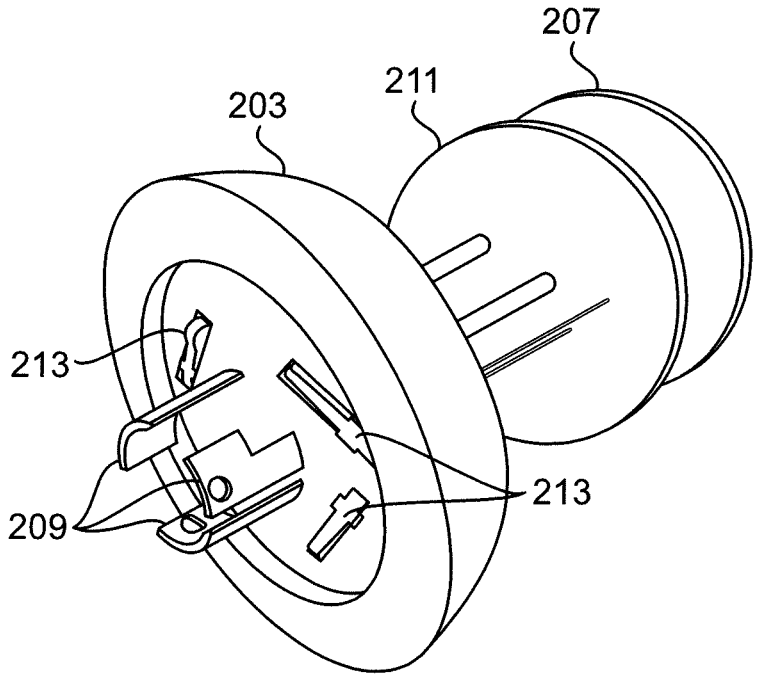
FIG. 10 provides an embodiment of a bottom side of a luminaire control device as described herein.
Figure 11:
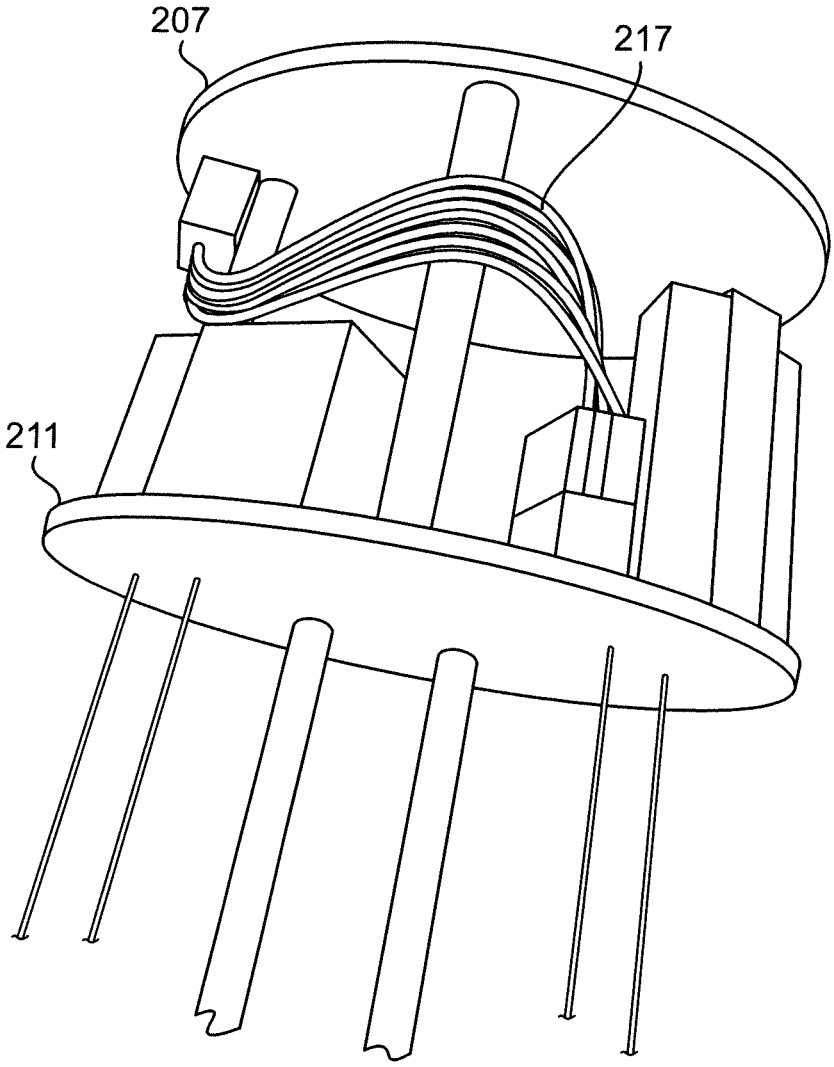
FIG. 11 provides an embodiment of line connections between receptacle pins and a power supply and between a power supply and a control system as described herein.
Figure 12:
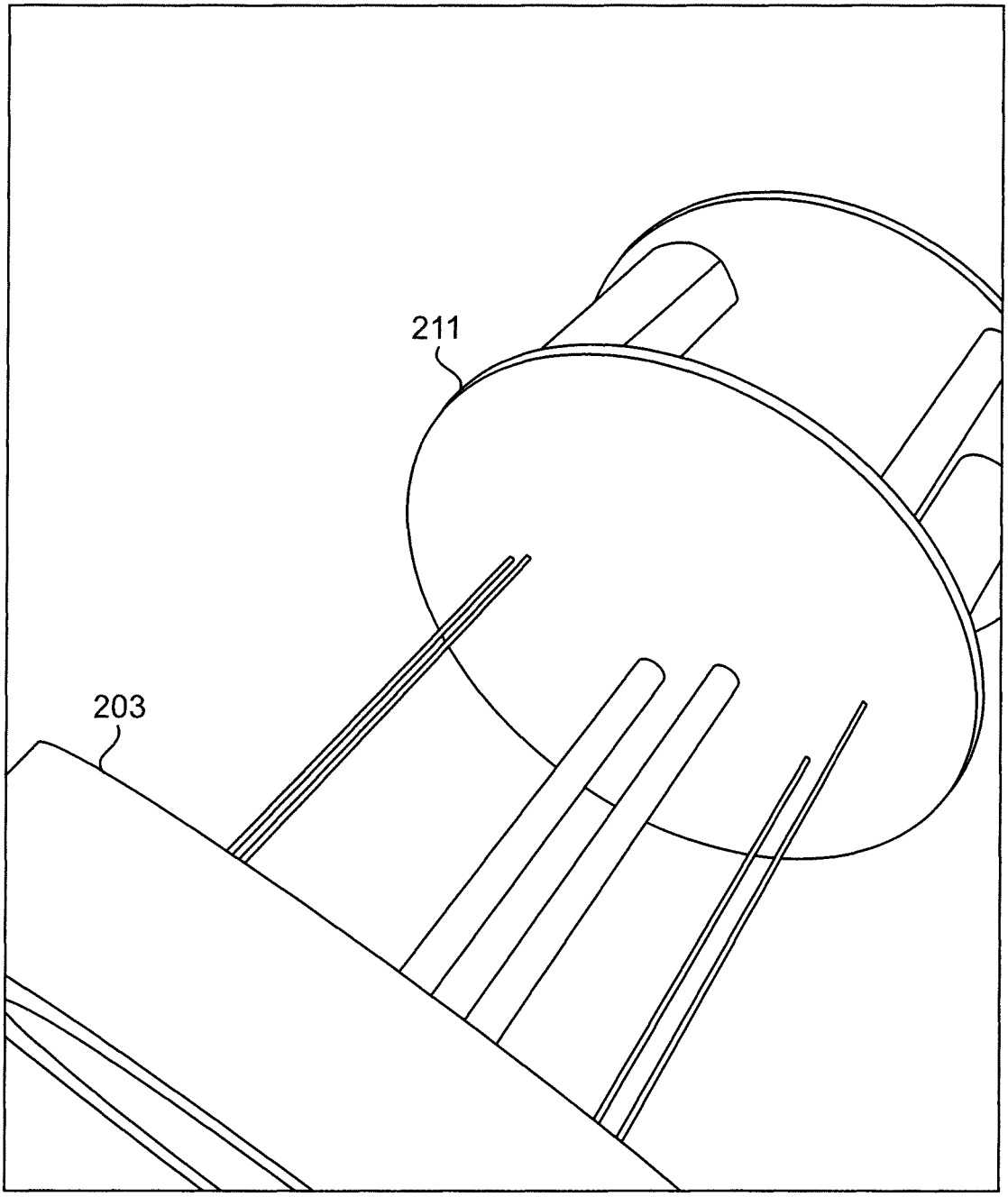
FIG. 12 provides another embodiment of line connection between receptacle pins and a power supply and between a power supply and a control system as described herein.

By way of example and not limitation, this relationship is shown in FIGS. 10, 11, and 12 with respect to the spring contacts (213). Also by way of example and not limitation, a standard may implement a 0-10 volt analog interface to indicate desired light intensity. A 10-volt signal indicates maximum light intensity and 0 volt signal indicates "off" or no light intensity. In the depicted embodiment, the two pairs provide two separate channels of control, referenced to as the "dual channel" aspect.

The depicted contacts (213) are arranged into pairs and each pair connects via the receptacle (115) to a different dimming driver within the luminaire (110) structure. Thus, each pair can be separately commanded or operated to control the luminaire (110) by components, circuitry, and logic in the control system (207).

Figure 8:
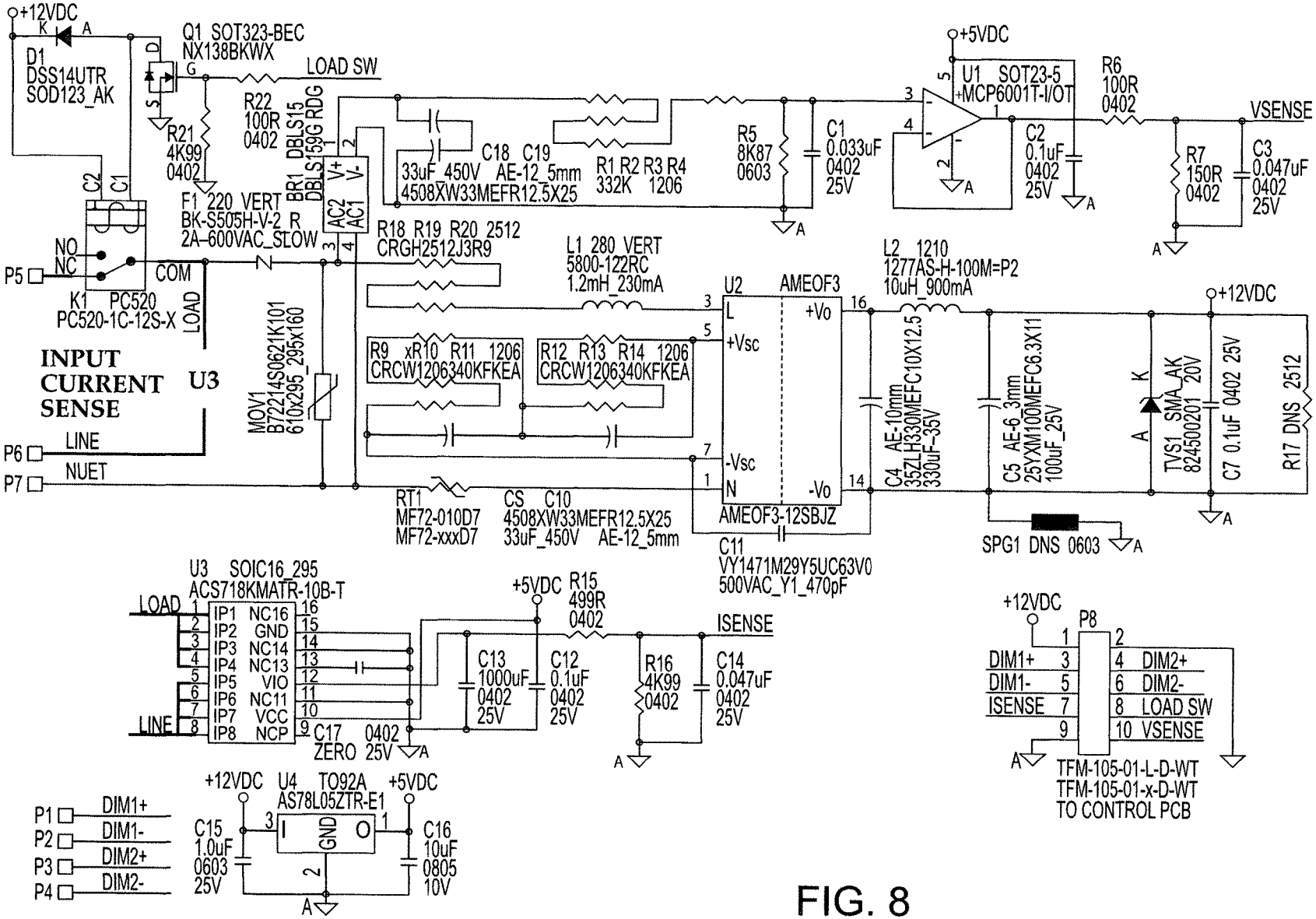
FIG. 8 provides a schematic diagram of a universal power supply for a luminaire control device as described herein.

The power supply (211) is designed and laid out so as to fit within the form factor of the housing (203) and (205), and comprises all components required to adapt the range of power conversion described herein, and leave sufficient surplus volume within the house (203) and (205) to accommodate a control system (207) and/or other components. FIG. 8 provides a schematic diagram of an embodiment of a power supply (211) implementing power conversion from a range of 90-528 VAC to 12 VDC. For example, header P8 provides the connection to route various electrical lines (e.g., to the control PCB/control system (207)). The current sensing function is at pin 7, P1 (DIM1+) is at pin 3, P2 (DIM1−) is at pin 5, P3 (DIM2+) is at pin 4, P4 (DIM2−) is at pin 6, and a load switch to the relay is at pin 8 of header P8. A device (201) having a form factor compliant with the applicable standards requires small components, yet must also step down voltage as high as 528 VAC to 12 VDC to operate a small electrical load in excess of 1 W, as high as 4 W, and preferably about 3 W to 3.3 W. In particular, the form factor defined by the ANSI standard is generally too small to allow the inclusion of all electronic components required to both convert all ranges of voltage commonly found in a municipal light pole power line, as well as fit a control system (207) and other desired components. Prior art components of appropriate size to be fitted within the device (201) form factor lacked the ability to provide power conversion in this range by a significant margin.

To achieve the required form factor, a transformer core may be custom wound to achieve a desired isolation voltage range within the volume or size limitations imposed by the standard. Additionally, or alternatively, a particular circuit layout may be used to minimize the physical footprint of the power supply (211) so as to fit within the form factor. The depicted embodiment of FIG. 8 has a small enough footprint to be contained within the form factor of the ANSI standard, while also accommodating the control system (207).

The depicted device (201) of FIG. 5 can accept as power input any range of AC current between about 90 and 528 VAC and convert this power input into a consistent level of DC power output. The specific power output may vary from embodiment to embodiment depending upon the power requirements of the associated device to be powered. In the typical embodiment, such as that in which the control system (207) is for controlling a luminaire (110), the power output is about 12 VDC. In a further embodiment, the power output is at least 12 VDC. In a further embodiment, the power output is at least 12 VDC at 140 mA, or about 1.7 W at 12 VDC. In a further embodiment, the average operational capacity is at least 12 VDC at 170 mA, or about 2.0 W at 12 VDC.

In certain embodiments, it may be desirable to have systems and/or apparatus for identifying differing power supply bases. By way of example and not limitation, it may be economical feasible to stock a power supply (211) for converting 90-277 VAC power, and a second power supply (211) for converting up to 480 VAC power. However, it is also desirable that the corresponding control system (207) be agnostic as to which power supply (211) it is packaged with, so that a single software version may be maintained, reducing development and maintenance costs. This may be done by using four pins on the headers connecting the power supply to the control system (207). One such pin would be a ground pin, and three would be signal pins. Depending on the pattern of the three pins connected to the ground line, it is possible to determine which power supply (211) is connected to the control system (207). The other lines not connected to the ground would then be left as floating lines. It should be noted that the ground and signal lines come from the control system (207) and the power supply (211) may only connect the pins together in a specific pattern. Pins D1, D2, and D3 are connected to microcontroller pins. However, in the preferred embodiment, it is desirable to use a uniform configuration of power supply (211) to minimize complexity and stocking requirements, and this element may not be used.

It will be appreciated that the power supply (211) may provide a DC power output at a particular level, but that this level may nevertheless remain too high for some uses. Thus, in some embodiments, a control system (207) may have further "step-down" components disposed thereon to further reduce the power level. For example, the control system (207) components may require power in the range of 3 to 4 VDC at 45-290 mA, or 0.15 to 0.95 W. In an embodiment, the control system (207) may comprise step-down circuitry so as to provide power to associated components in the range of 1.35 W to 4 W. In an embodiment, power is supplied at 3.3 V at 0.410 mA on the control system (207).

Figure 6:
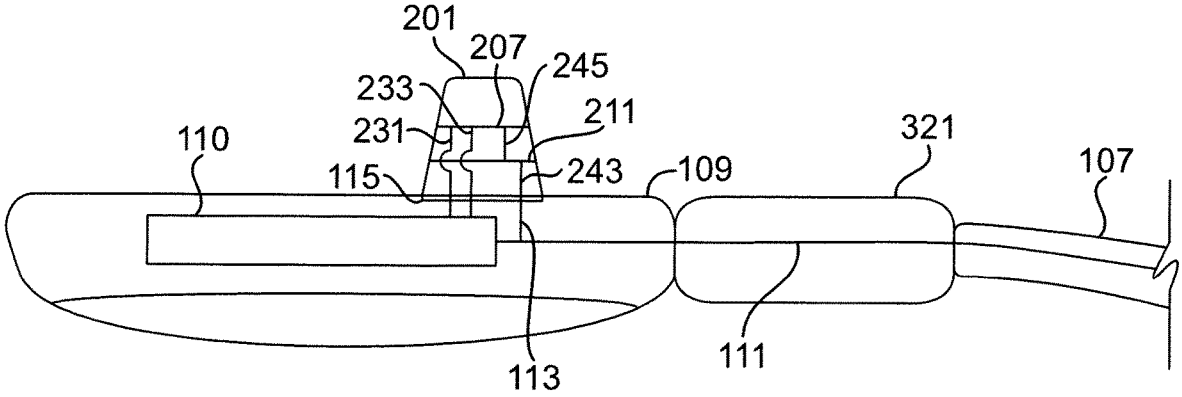
FIG. 6 provides a schematic diagram of an embodiment of a dual-channel luminaire control device as described herein deployed to control a municipal luminaire.

The depicted control system (207) contains components and/or program logic or software to operate the luminaire (110) via one or more control channels, (231) and (233). The depicted embodiment of FIG. 6 is a seven-pin dimming receptacle (115). In an embodiment using a five-pin receptacle, the auxiliary control line (233) would not be present, and a single channel of control line (231) would be used instead. As can be seen in the depicted embodiment of FIG. 6, both control channels (231) and (233) are operatively connected to the luminaire (110) through the dimming receptacle (115).

The control system (207) generally will comprise a circuit board and various components to perform one or more non-power conversion functions. The particular nature of these functions, and, by extension, the associated components, will vary from embodiment to embodiment depending upon the particular needs of any given implementation. Generally, it is anticipated that the control system (207) will usually comprise a processing system (221), such as a computer, microprocessor, microcontroller, controller, or other logic unit, for operating the components of the control system (207) and sending control signals on one or more of the control channels for operation of one or more luminaire(s) (110).

Typically, the control system (207) will further comprise a memory (223) or storage (223) containing executable instructions for operating the device (201) or luminaire(s) (110). The control system (207) may further comprise other appropriate hardware systems and circuitry as necessary to implement the functions described herein. The control system (207) components and program logic/instructions operate the luminaire(s) (110) using control channels (231) and (233) in accordance with the needs of the given embodiment. Other components may also be included in the control system (207) or otherwise disposed within the interior of the assembled device (201) and powered by the power supply (211). These other components may include, but are not necessarily limited to, a microprocessor, a controller, a photocell or other daylight sensing technology, and/or expansion ports for other sensors.

The components of the control system (207) receive power via a wired connection to the power output from the power supply (211). The particular arrangement of such a wired connection will vary from embodiment to embodiment, but typically will be consistent such that only one, or a small number, of power supply (211) configurations need be produced, and any number of different control system (207) or other powered interior components may be used with that one or small number of power supplies (211).

By way of example, and not limitation, one or more of the control channels (231) or (233) could be used to alter the color temperature of the luminaire (110). Alternatively, one channel (231) could be used to control the color temperature of the luminaire (110), while the other channel (233) is used to control the light intensity of the luminaire (110). In this fashion, the luminaire control device (201) has the ability to simultaneously control multiple operational states of the luminaire (110). For example, when there is insufficient light, such as dusk, dawn, overnight, or during inclement weather, power is restored and the luminaire (110) is illuminated.

In an embodiment, the control system (207) may further include a short- or long-range transceiver (225), such as, but not necessarily limited to, a radio transceiver. The transceiver (225) is preferably adapted to receive and transmit using a standard-complaint protocol over short- or long-range distances, such as via a local short-range protocol, a Wi-Fi protocol, or a long-range wireless data protocol, including but not limited to a protocol in the IEEE 802.11 family of protocols. The transceiver (225) may be used to send to or receive from remote devices information, instructions, or requests relating to control of the device (201) and/or the luminaire(s) (110) to which it is connected. Instructions received at the transceiver (225) may then be processed by a processing system (221) and control signals may be sent to the luminaire(s) (110) based on the data received via the transceiver (225).

By way of example and not limitation, the control system (207) may include a mesh radio transmitter, such as that described in U.S. Prov. Pat. App. No. 62/792,213, filed Jan. 14, 2019, and U.S. Pat. No. 10,260,719, issued Apr. 16, 2019, the entire disclosures of which are incorporated herein by reference. In this fashion, the device (201) effectively functions as an IOT device capable of being operated using the systems and methods described in the foregoing references. By including in the control system (207) a wireless transceiver and program logic for receiving, processing, and issuing command instructions to the appropriate channel wires, the luminaire (110) may be remotely operated over a telecommunications network using the device (201). In an embodiment, and as further described in the other applications referenced elsewhere in this disclosure, the control system (207) may include a microprocessor executing program instructions from a memory, which operate communications hardware to exchange data and instructions with other nearby devices (201). Additionally, or alternatively, this may be done to communicate over a WAN (503), including but not limited to a cellular network.

Also by way of example and not limitation, the control system (207) may include other inputs and outputs, including but not limited to ports or connections for other IoT devices to be controlled by the device (201) via wireless communications as described in the above-referenced applications and elsewhere herein. Exemplary embodiments of these and other components contemplated for use with the devices described herein are also described in the above-referenced applications.

Figure 9:
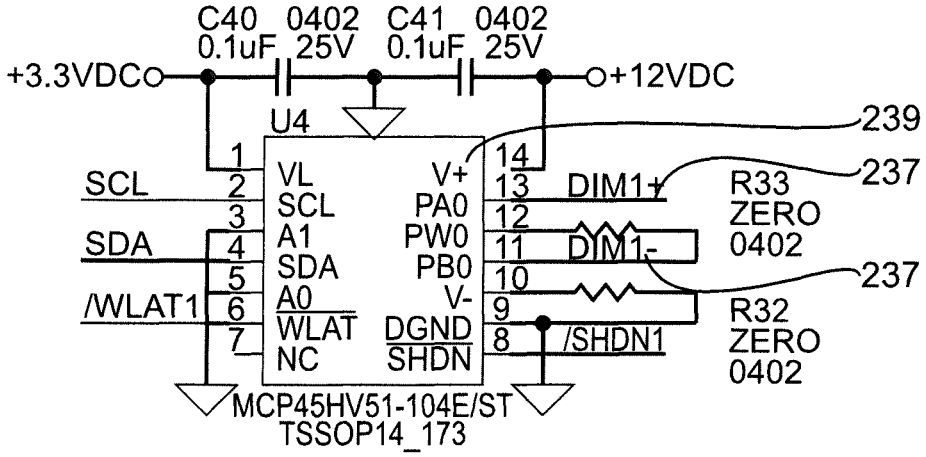
FIG. 9 provides an embodiment of line connections between a microcontroller and a potentiometer to implement a dimming circuit.
Figure 9:
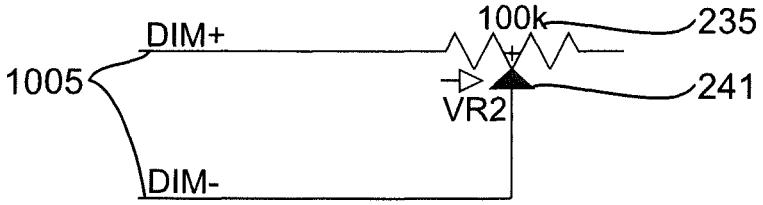

As discussed in the background section, one problem with dimming receptacle standards is that prior art implementations have used pulse-width modulation dimming, which results in flicker when using the dimming circuits. To overcome this, in the embodiment depicted in FIG. 9, a potentiometer (235) may be included in the control system (207) with at least one of the dimming pin sets (237), operated by a microcontroller (239). In the depicted embodiment, the microcontroller (239) is an integrated circuit. As seen in FIG. 9, one set of dimming pins (237) is shown, but the second set (not shown) could also be wired to a potentiometer (235). In the depicted embodiment, the first dimming pin DIM− is connected to the microcontroller (239) at pin PW0 (#11) in FIG. 9. This is the control line for the wiper (241) (e.g., a sliding contact on a resistive strip in the potentiometer that alters the amount of resistance in the circuit). These configurations may be used to create, in effect, a digital "control knob" within the apparatus for controlling luminaire intensity, with reduced flicker and self-correction in the event of pin misalignment.

FIGS. 10, 11, and 12 depict an embodiment of a power supply (211) showing the connecting elements to the control system (207). In an embodiment, a single header is used to connect elements of the power supply (211) to the control system (207). This may be done, for example, by connecting a cable (217) from the control system (207) to the header. In an alternative embodiment, the connecting elements may comprise two rows of headers. That is, the "stack" in the device (201) is ordered, from bottom to top: base (203), then power supply (211) on top of the base (203), and then one or more control systems (207) on top of the power supply (211).

In an embodiment, the number and arrangement of headers may be selected to provide mechanical stability for elements disposed above the power supply (211), including but not necessarily limited to a control system (207). In the depicted embodiments, the rows of headers comprise rows of 0.1" headers, but this is exemplary only and not necessarily limiting. It is specifically contemplated that a single header may suffice in the preferred embodiment.

In an embodiment, at least one of the headers is a conductive signal-carrying element. It is contemplated that at least two pins each of 12 VDC power and a ground line are provided for redundancy to ensure power flow in the event of a mechanical failure of one set of pins. Thus, in the preferred embodiment, at least four pins are devoted to power transmission from the power supply (211) to a control system (207). However, in other embodiments, there may be more (or less) pins having this function.

In an embodiment, at least one header pin provides another function. By way of example and not limitation, a pin may provide signals pertaining to dimming. That is, a controller on the control system (207) may relay signals via the pins to the luminaire to which the device (201) is attached to control dimming functions. Additionally, or alternatively, wires for transmitting dimming controls or instructions may by connected directly to pins on the plug and carried directly to the control system (207). Such wires are not necessarily power supply lines but rather function effectively as a bus, and thus may bypass the power supply (211).

In the depicted embodiments, the components on the control system (207) are in turn powered by the adjusted power output at the appropriate voltages produced on the power supply (211). The device (201) may further include mechanical struts or supports to provide stability and separation between the power supply (211) and the control system (207).

FIG. 6 depicts an embodiment of the municipal luminaire control device (201) installed on a light head (109) containing a luminaire (110). As can be seen in the depicted embodiment of FIG. 6, the luminaire (110) is enclosed within the light head (109), which is attached to a light arm (107). In the depicted embodiment, an enclosure device (321) is installed in-line between the arm (107) and light head (109). The municipal luminaire control device (201) is plugged into a dimming receptacle socket (115) on the dorsal side of the light head (109). A municipal power line (111) is disposed within the arm (107) and passes through the enclosure (321) to power the luminaire (110). This line (111) is connected (113) to the power supply interface in the dimming receptacle (115), as defined by the applicable standard.

When the luminaire control device (201) is attached to the receptacle (115), an electrical connection (243) is formed between the power line (111) and the power supply (211) inside of the device (201). The power supply (211) receives alternating current from municipal power line (111), converts it to direct current and steps down the voltage to an amount useable by the control system (207). The resulting direct current is indicated in FIG. 6 as a wired connection (245). The components of the depicted control system (207) are then powered by the direct current received (245) from the power supply (211).

Figure 7:
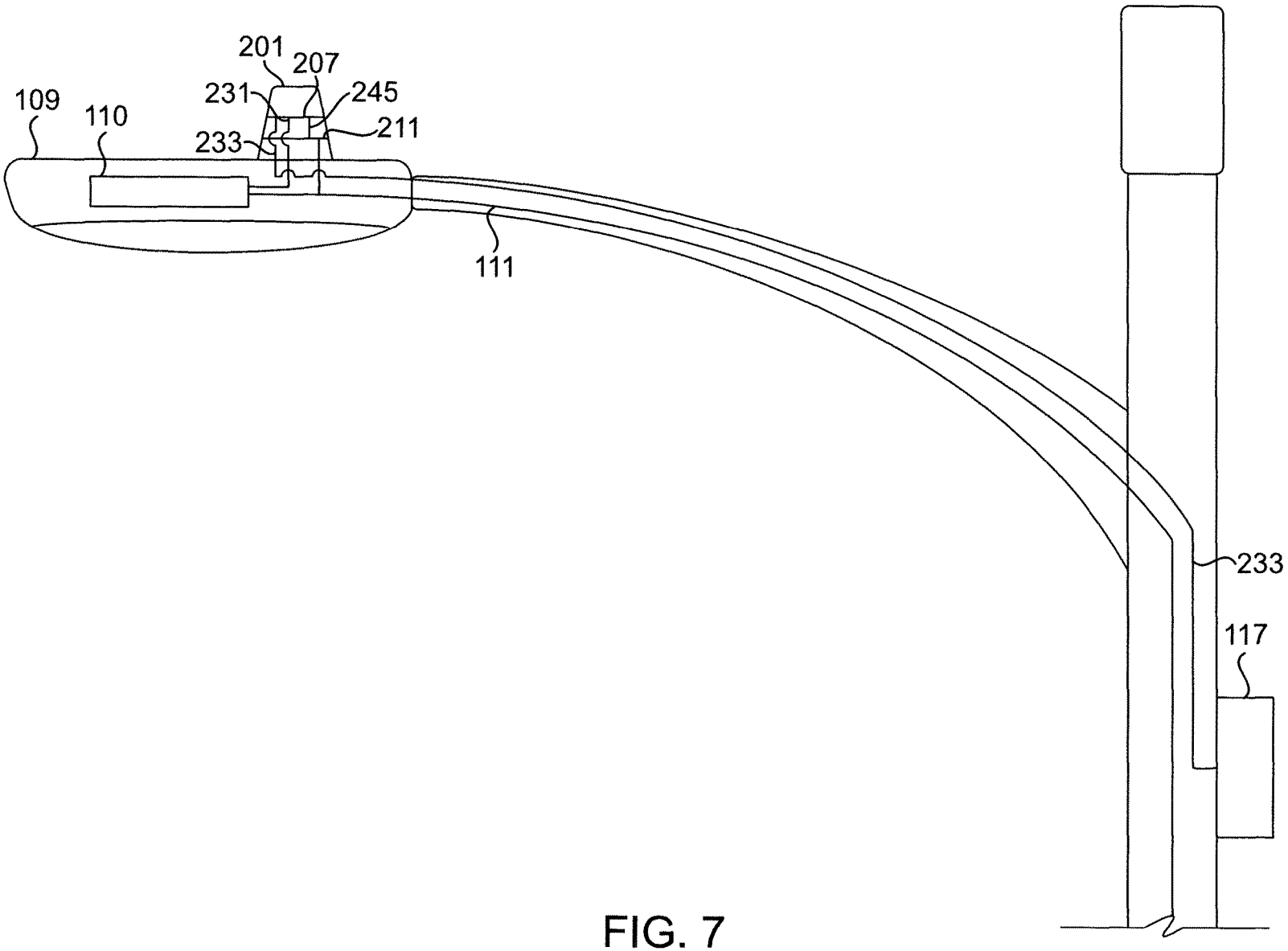
FIG. 7 provides an alternative schematic diagram of an embodiment of a dual-channel luminaire control device as described herein deployed to control two municipal luminaires.

In an alternative embodiment, such as that depicted in FIG. 7, the luminaire control device (201) may be used to control two different luminaires (110) and (117). In the depicted embodiment of FIG. 7, a first luminaire (110) is contained in the light head (109) in a similar fashion as described with respected to FIG. 6, but a second luminaire (117) is disposed elsewhere on the municipal infrastructure pole (103). In this embodiment, the primary channel (231) (e.g., DIM1) may be used by the luminaire control device (201) to operate the primary luminaire (110) in the light head (109), while the auxiliary control channel (233) (e.g., DIM2) may be connected to the second luminaire (117) to control that luminaire (117) instead. In the depicted embodiment, for example, the first luminaire (110) is a traffic luminaire disposed above a street to illuminate the surface below for traffic safety, while the second luminaire (117) is disposed next to the sidewalk to provide illumination and safety to pedestrians adjacent to the street. In this fashion, the luminaire control device (201) can independently operate both luminaires (110) and (117) in accordance with the operational needs of the implementation.

In an embodiment, both the DIM1 and DIM2 commands are used to control a single luminaire (110). By way of example and not limitation, DIM1 may be used to control a first aspect of the luminaire (110) and DIM2 may be used to control a second aspect of the luminaire (110).

In an embodiment, one or more of the luminaires (110) and (117) may be adapted or designed to respond to specific commands issued via the control channels (231) and (233). The specific nature of this design will depend upon the needs of the implementation. By way of example, and not limitation, if the design is intended to provide variance in light intensity, then the luminaires (110) and (117) may be designed to alter light intensity in response to commands or voltages received via the channels (231) and (233). It should be noted that in the depicted embodiment of FIG. 7, the enclosure (321) is omitted for illustrative simplicity.

In an embodiment, a specialized luminaire (110) may be used, which may be specifically adapted to accept and respond to commands issued via the dimming receptacle. That is, although the receptacle is intended for a dimming function (e.g., by use of a photocell to detect sunlight and dim the luminaire (110) when there is sufficient ambient light that use of the luminaire (110) is unnecessary), the standard defines a mechanical and electrical interface which can be used to transmit any number of types of instructions via the control channels (231) and (233). For example, an LED light fixture may be programmed to respond to commands received on DIM1 and/or DIM2 (or just on DIM).

Alternatively, an existing light head (109) may be retrofitted without the necessity of installing a new luminaire (110). For example, the device (201) is installed in a dimming receptacle atop a street light (103) to replace a photo control cell. The device (201) may itself include a photocell and receive a signal from that photocell which is also used to control the luminaire (110), and/or may operate the luminaire (110) in accordance with other criteria depending upon the function of the control system (207).

An improvement over prior art devices is that the ballast drivers may not fully implement "turning off" the luminaire (110). For example, a "1-100" driver is configured to set the light intensity to between 10% of maximum intensity and 100% of maximum intensity. Thus, if a control signal received on P1, P2, P3, or P4 indicates a voltage of zero, meaning a command to cut the light entirely, the ballast driver may nevertheless maintain the luminaire (110) at 10% light intensity. This in turn means that, in a prior art device in which a photovoltaic cell is installed, even with full sun in broad daylight with a 0 volt command signal to the driver, the driver maintains the light on at 10% power, wasting electricity. In one embodiment of the present device, the power supply (211) and control system (207) may implement command logic which cuts line power to the driver entirely, thus ensuring that no power is wasted by a 1-100 driver forcing the luminaire (110) to 10% intensity regardless of the analog control signal.

The luminaire control device (201) described herein may be used to control functions beyond dimmable controls. For example, in an embodiment, the luminaire control device (201) may utilize one or both channels to provide various instructions and functions to the luminaire (110). The particular functions of each channel may vary from embodiment to embodiment while remaining within the requirements of the applicable standard. By way of example and not limitation, the signals transmitted over the control lines may alter the color temperature of the light. In one embodiment, DIM1 may control the 4000 Kelvin temperature range, and DIM2 may control the 6000 Kelvin temperature range. Thus, by increasing DIM1, the color tone of the light becomes more yellow, and by increasing DIM2, the color tone of the light becomes more white. This, in combination with the potentiometer implementation, facilities a smooth gradient of light temperature.

The depicted design has the advantage of being able to receive any amount of municipal voltage commonly distributed in the United States and convert that voltage to a uniform output for use by the control system (207). This allows a single luminaire control device (201) to be manufactured and stocked for any given implementation, and avoids the need for the city to manage a stockpile of multiple devices (201) accepting different voltages, and to monitor and track which poles in a given power grid operate at which voltages. Utility crews may simply pick up a device (201) and install it in any pole, and be confident that the voltage will be accepted, converted, and usable without damaging the device (201). This design also has the advantage of directly utilizing the municipal power supply (111) without the need to include batteries, or photocells, or other solutions which cannot provide a consistent amount of power, resulting in the control system (207) being potentially unpowered and either malfunctioning, or failing to operate the luminaires (110) correctly. Additionally, by utilizing both control channels (231) and (233), multiple aspects of a single luminaire (110) may be controlled by a single device (201), or multiple luminaires (110) may be independently controlled.

Also described herein are systems and methods for providing "localization" of moving objects (e.g., people, vehicles, equipment) by using beacons installed on municipal fixtures (103), such as light and utility poles. The beacons transmit, in the ordinary course of network communication, an identifier. Because the fixtures (103) do not move, the fixed geographic locations of the fixtures (103) can be associated in a database with a unique identifier broadcast by the beacon installed on the fixture (103). When a moving device having a wireless transceiver approaches the fixture (103), it will receive transmissions from the beacon including the identifier, and can then look up the identifier in the database to get the geographic coordinates. This can be done even without the moving device's wireless transceiver authenticating or connected to the beacons' network. This location can then be used for a wide variety of applications and purposes.

Figure 13:
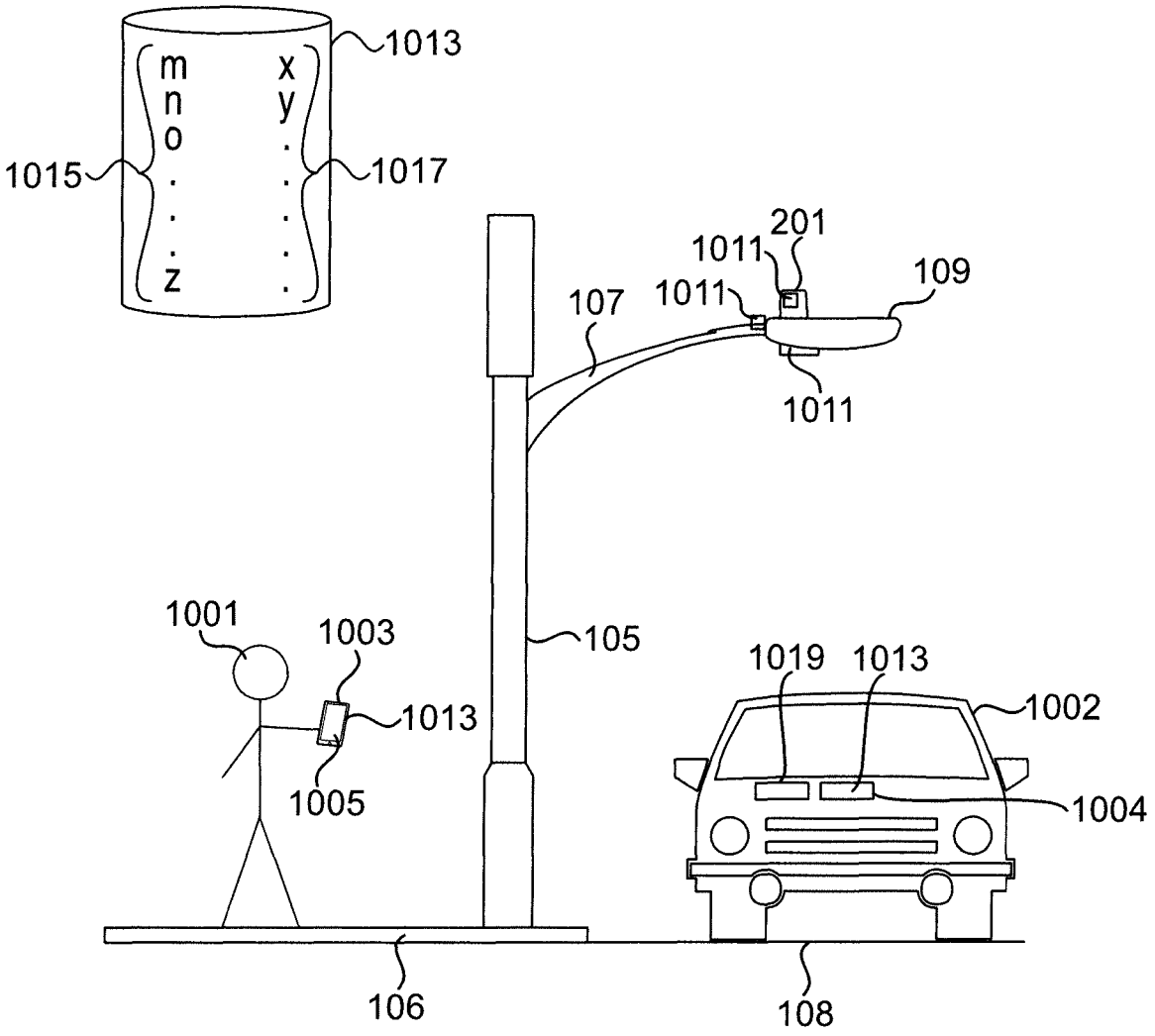
FIG. 13 provides an embodiment of a system and method for determining a geographic location of a movable device as described herein.

As shown in the depicted embodiment of FIG. 13, the luminaire control device (201) may also be used for a number of other purposes, and may incorporate other components to facilitate other functions unrelated to the luminaire control system (207). For example, the control may be designed and/or programmed with circuitry and/or computer logic to a wide variety of functions in addition to those described in this disclosure. As described in other patent applications referenced elsewhere herein, the device (201) may be one of a plurality of devices in a network of similar devices, some or all of which may be equipped or otherwise connected with one or more sensors on or at a utility pole (103). The data detected by the devices (201) may be collected and shared via a wireless network among such devices (201), including but not necessarily limited to a mesh network (505). This data may be used to "localize" where specific incidents or types of incidents have taken place. This data may be provided to municipal authorities, emergency responders, and/or the general public or private parties for use, processing and consumption. The data may be used, for example, in a consumer/end-user software application.

In an embodiment, a short-range radio transceiver (1011), or "beacon," would be installed on some, most, or all of the devices (201) in a given deployment. This may be done by including the beacon (1011) in the control system (207), for example. Such beacons (1011) could be, but are not necessarily limited to, radio transceivers using a wireless communication protocol in the IEEE 802.11 family of protocols, or some other protocol. Examples of suitable protocols include Bluetooth™, WiFi, Ultra-wideband, ISM (Industrial, Scientific, and Medical) bands, and other radio types. In an embodiment, a beacon (1011) may be enclosed within the device (201) or attached in a different location, such as in a photocell or other device using the dorsal receptacle (115), behind the luminaire (110) in an enclosure, or using a Zhaga Book 18 connection.

Such beacons (1011) commonly include a unique, or semi-unique, identifier (1015) which is broadcast with ordinary transmissions as part of the wireless communication protocol. This identifier (1015) helps other devices within broadcast range identify the source of a given wireless signal or data packet. A database (1013) could be assembled which associates, for each unique identifier (1015), a geographic location (1017) where the beacon (1011) having that identifier (1015) is installed (e.g., the geographic coordinates (1017) of the light pole (103) into which a luminaire control device (201) containing the beacon (1011) is plugged). This database (1013) could be stored and accessed locally (e.g., on a mobile device (1003), vehicular telematics system (1004), etc.) or hosted remotely for query/access (e.g., the mobile device (1003) or vehicular telematics system (1004) transmits the beacon identifier (1015) to the remote hosted database (1013), and the database (1013) returns the geographic coordinates (1017) for that beacon identifier (1015)).

To locate a given device (1003) or (1004), the device (1003) or (1004) receives the identifier (1015) for one or more beacons (1011) and looks up (locally or remotely) the associated geographic coordinates (1017). The location of the device (1003) or (1004) can then be approximated to varying degrees of precision. Techniques for doing so include received signal strength indicator analysis, angle of arrival using phased antenna arrays, and other techniques known in the art. The location information calculated can then be used to replace, supplement, or augment other location technologies.

Any number of applications could be programmed or developed to take advantage of this increased accuracy. These include but are not necessarily limited to vehicular navigation and assistant technologies such as lane assist, GPS navigation assistance, routing, autonomous vehicle location and piloting, and traffic flow analysis. Other exemplary applications include managing small or shared commuter vehicle fleets such as bicycles and e-scooter pools, where the location data may be used to geofence the range of the fleet to prevent operation outside of permitted areas. This reduces the need to rely on GPS transmitters, which drain battery life and shorten the operational life of e-scooters.

The technology may be used in smart mobile devices (1003), such as smart watches, smart phones and tablets, virtual and augmented reality headsets, smart earbuds, and other portable and wearable technology. This again allows for location technology without requiring a GPS transceiver. This location data may also be used in activity location tracking technologies, such as exercise applications. This location data may also be used in augmented reality applications and to assist in automated or piloted operation of sidewalk delivery robots, drones and the like.

This localization technology also has application in any situation where GPS alone is not sufficiently accurate, such as cities or areas with low-quality or inconsistent GPS coverage, or applications unsuitable for the operational requirements of a GPS transmitter, such as devices with small form factors and/or limited battery life. This localization technology also has application in any situation where geofencing is desired, such as to prevent operation of devices inside of, or outside of, a geographically defined area.

The locational information may be particularly useful in municipal areas with a large number of tall buildings, which can impede or distort wireless signals and even satellite signals. Additionally, the power drain of long-range transceivers, such as GPS, can be significant, whereas the power drain of a small localized beacon is relatively small. To save battery life, the location system described herein may be used to temporarily replace or supplemental other location services, such as but not necessarily limited to, GPS. This locational system may also be used to provide a secondary or supplemental locational service in situations where limitation in operating system designs inhibit or prevent the use of GPS or other location services.

By way of example and not limitation, the device (201) may comprise circuitry and/or program logic implementing a message/content delivery method suitable for delivering messages or content to nearby pedestrians (1001) or vehicles (1002). In this exemplary embodiment, the mere fact that a mobile device (1003) carried by a pedestrian (1001) or motorist, or a vehicular telematics system (1004) of a vehicle (1002) is able to detect the presence of the beacon (1011) is indicative that the pedestrian (1001) or vehicle (1002) is physically proximate to the beacon (1011).

The location of the pedestrian (1001) or vehicle (1002) can then be determined in real time with precision using any number of techniques. When the mobile device (1003) or telematics system (1004) is close enough to detect wireless signals from the beacon (1011), whether or not mobile device (1003) or telematics system (1004) actually joins the network, the unique identifier (1015) for nearly beacon(s) (1011) can be received and looked up in the database (1013) to find the associated geographical location (1017) for the mobile device (1003) or telematics system (1004). This location can then be used for messaging or content delivery (e.g., via a mobile application (1005) or within the vehicular telematics system (1004)).

The action taken may vary from embodiment and embodiment and will depend on the particular design and business goals of the implementation. For example, the user device (whether a mobile device (1003), telematics system (1004), or some other type of user device) may display for the user (1001) a map of the city highlighting nearby attractions, businesses, or amenities that are open, and/or provide walking or driving directions as the case may be, or may indicate the location of nearby rideshare scooters or other small personal vehicles. In another embodiment, the location may be used to deliver spot marketing, such as coupons or promotions for nearby businesses or events. In a still further embodiment, hazard information may be presented, such as weather alerts, flood warnings, street closures, or reports of emergencies or emergent situations such as recent nearby crime or other dangerous situations with directions to nearby shelter, an alternate path, or other information.

By way of further example, another device (201) in the network may be equipped with a microphone programmed to detect gunshots or a vehicular accidents. If one is detected, the devices (201) may further share that information within the network, including the location of the device (201) which detected the incident. That information may then be shared with the user device (1003) to provide a location for the incident in question and allow the user (1001) to avoid the impacted area or seek shelter.

A number of marketing applications are possible. By way of example, an outdoor advertising screen (e.g., an LED display) could be attached to the light pole, and when a mobile device (1003) is detected as approaching, turned on to display a promotional message, such as ad placement for nearby businesses. Alternatively, if the user (1001) has a mobile device (1003) with software (1005) enabled to receive and display such messages, the mobile device (1003) could detect the nearby beacon (1011) and provide the marketing content via an alert the mobile device (1003), including commercial incentives, such as a coupon or discount code.

The devices and methods described herein may also or alternatively be used in conjunction with vehicular location and traffic management systems. In such an embodiment, a vehicle (1002) is equipped with a wireless transceiver (1019) which communicates with one or more beacons (1011) in a municipal deployment. These communications may then be analyzed for various purposes, including but not necessarily limited to routing, location, driver assistance, and autonomous piloting. This could be done, for example, by including a radio transceiver (1019) in the vehicle and using techniques such as analysis of the signal strength, and/or change in signal strength as the vehicle (1002) moves, to determine the vehicle's (1002) location, heading, speed, and other characteristics. Other technologies may also be used, such as phased array antennas (1019).

The analysis could take place at the vehicle (1002), at the beacon (1011), or at a remote location, but is preferably performed at the vehicle (1002). This is because although the vehicle (1002) could connect to a private network comprised of the plurality of beacons (1011), this is not necessary. As described elsewhere herein, in the ordinary course of operating a wireless network, the beacons (1011) send out frequent status or presence signals, which the transceivers (1019) can detect. The characteristics of these waves can then be analyzed to determine positional and/or locomotive characteristics of the vehicle (1002) without authenticating or connected to a network.

Again, because the beacons (1011) are attached to a light pole (105) with a fixed geographic location (1017) that can be known, the vehicle's computer (1004) can be loaded with a database (1013) of node identifiers (1015) and geographic locations (1017). By comparing the known location (1017) of a given beacon (1011) (e.g., by looking up a unique identifier (1015) associated with the beacon (1011) in a database (1013)), the mere fact that the vehicle (1002) is within range to receive transmissions from a given beacon (1011) can pinpoint a vehicle's (1002) location to a relatively small geographic footprint. Further analysis of signal characteristics can then refine that determination to greater accuracy, and potentially further determine characteristics such as speed and heading. By using multiple beacons (1011), accuracy can be further improved.

By way of example and not limitation, suppose a vehicle is traveling down a municipal street with lights outfitted with the luminaire control systems described herein. The vehicle is positioned next to a first node N1, has just passed a second node N2, and is approaching a third node N3. The signal strength of node N1 will usually be strongest, absent unusual interference, and the signal strength of N2 will be weaker than that of N1 and will grow weaker over time as the vehicle moves further away from the light pole containing N2. Conversely, as the vehicle approaches N3, the signal strength will get stronger. By comparing these various signal strengths, and examining how they change over time, even over relatively small increments, direction, position, and speed can be estimated or inferred.

Although the exemplary embodiments described herein are in the context of a control system for operating a luminaire in a municipal setting, the control system, power supply, and other elements described herein are suitable for use in other applications, in which the control system may implement different or additional functions.

Described herein, among other things, is a luminaire control device comprising: a base having a top side and an opposing bottom side, said bottom side having a plurality of power supply electrical connections disposed thereon and a plurality of control electrical connections disposed thereon; an enclosure sized and shaped to attach to said base to form a housing having an interior volume defined by said enclosure; a power supply disposed within said enclosure and in electrical communication with said first plurality of power supply electrical connections, said power supply comprising a plurality of electrical components selected and arranged to receive from said plurality of power supply electrical connections alternating current and convert said received alternating current to direct current; and a control system disposed within said enclosure and in electrical communication with plurality of control electrical connections, said control system comprising a non-transitory computer-readable storage medium and a processing system electrically powered by direct current from said power supply, said non-transitory computer-readable storage medium comprising instructions which, when executed by said processing system, transmit control signals via said plurality of control electrical connections.

In an embodiment of the luminaire control device, said range of voltages is a range of municipal distribution voltages. In another embodiment of the luminaire control device, said range of municipal distribution voltages is between about 90 and 528 volts, inclusive.

In an embodiment of the luminaire control device, said plurality of electrical components is further selected and arranged to convert said received alternating current to direct current of about 12 volts.

In an embodiment of the luminaire control device, said control system further comprises a radio transceiver.

In an embodiment of the luminaire control device, said radio transceiver communicates via a standard in the 802.11 family of wireless protocols.

In an embodiment of the luminaire control device, said control signals comprise dimming signals.

In an embodiment of the luminaire control device, said control signals comprise color temperature signals.

In an embodiment of the luminaire control device, said plurality of control signals comprise color temperature signals.

In an embodiment of the luminaire control device, a first pair of control electrical connections in said plurality of control electrical connections defines a first control channel and a second pair of control electrical connections in said plurality of control electrical connections defines a second control channel.

Described herein, among other things, is a municipal illumination system comprising: a municipal utility pole having a light arm disposed on a side thereof, said light arm having a municipal light head attached to a distal end thereof, said municipal light head comprising a dimming receptacle and a luminaire in electrical communication with said dimming receptacle, and said municipal utility pole comprising a municipal power line therein, said municipal power line in electrical communication with said dimming receptacle and said luminaire; and a luminaire control device installed in said dimming receptacle and comprising; a housing having an interior volume; a power supply disposed within interior volume and in electrical communication with said municipal power line via said dimming receptacle, said power supply receiving alternating current from said municipal power line at a first voltage and comprising electrical components selected and arranged to convert said received alternating current to direct current at a second voltage; and a control system disposed within said enclosure and in electrical communication with said luminaire via said dimming receptacle, said control system comprising a non-transitory computer-readable storage medium and a processing system electrically powered by direct current from said power supply, said non-transitory computer-readable storage medium comprising instructions which, when executed by said processing system, transmit control signals to said luminaire via said dimming receptacle.

In an embodiment of the municipal illumination system, said first voltage is a range of municipal distribution voltages. In another embodiment of the municipal illumination system, said range of municipal distribution voltages is between about 90 and 528 volts, inclusive.

In an embodiment of the municipal illumination system, said second voltage is about 12 volts.

In an embodiment of the municipal illumination system, said control system instructions, when executed by said processing system, cause control signals to be transmitted to said luminaire via a first control channel and a second control channel.

In an embodiment of the municipal illumination system, further comprising a second luminaire disposed on said municipal utility pole, said control system instructions, when executed by said processing system, cause control signals to be transmitted to said luminaire via a first control channel and cause control signals to be transmitted to said second luminaire via a second control channel.

In an embodiment of the municipal illumination system, said luminaire is further comprised of a radio transceiver adapted to wirelessly receive instructions for control.

Also described herein, among other things, is a method for determining a geographic location of a movable device comprising: providing a plurality of municipal infrastructure fixtures, each municipal infrastructure fixture in said plurality of municipal infrastructure fixtures installed at a fixed geographic location having associated geographic coordinates; installing, on each municipal infrastructure fixture in said plurality of municipal infrastructure fixtures, a wireless transceiver having an associated unique identifier, said wireless transceiver configured for wireless data exchange according to a protocol; for each municipal infrastructure fixture in said plurality of municipal infrastructure fixtures, associating, in a database, said unique identifier of said wireless transceiver installed on said each municipal infrastructure fixture with said geographic coordinates of said each municipal infrastructure fixture; for each municipal infrastructure fixture in said plurality of municipal infrastructure fixtures, said wireless transceiver installed on said each municipal infrastructure fixture wirelessly broadcasting, in accordance with said protocol, a plurality of transmissions including said unique identifier of said installed wireless transceiver; receiving, at a second wireless transceiver in said movable device, from a first installed wireless transceiver installed on a first municipal infrastructure pole of said plurality of municipal infrastructure poles, at least one transmission in said plurality of transmissions including said unique identifier of said first installed wireless transceiver; receiving, from said database, said geographic coordinates of said first municipal infrastructure fixture, said received geographic coordinates determined by searching said database for said unique identifier contained in said received at least one transmission; and at said movable device, determining a geographic location of said movable device using said received geographic coordinates.

In an embodiment of the method, said movable device is one of the following: a smart phone, a tablet computer, a portable computer, a wearable computer, or a vehicle.

In an embodiment of the method, at least some of said plurality of municipal infrastructure fixtures are street lights having a light head containing a luminaire.

In an embodiment of the method, at least some of said light heads comprise a dimming receptacle and, for said at least some of said light heads, said installing comprises installing said wireless transceiver in a luminaire control device connected to said at least some light heads via said dimming receptacle.

In an embodiment of the method, an enclosure is disposed between said light arm and said light head and said installing comprises installing said wireless transceiver in said enclosure.

In an embodiment of the method, the method further comprises: selecting a message to communicate to an end user of said movable device based at least in part on said determined geographic location of said movable device; and displaying to said end user, on a display of said movable device, said selected message.

In an embodiment of the method, said selected message comprises an emergency notification concerning an emergent condition occurring contemporaneously with said displaying, said emergent condition affecting a geographic region proximate to said determined geographic location of said movable device.

In an embodiment of the method, said selected message comprises a marketing notification.

In an embodiment of the method, said marketing notification is about a commercial enterprise physically proximate to said determined geographic location of said movable device.

In an embodiment of the method, said marketing notification is about an event occurring contemporaneously with said displaying, said event taking place physically proximate to said determined geographic location of said movable device.

In an embodiment of the method, said marketing notification includes an incentive to make a purchase.

In an embodiment of the method, the method further comprises: receiving, at said second wireless transceiver, from a second installed wireless transceiver installed on a second municipal infrastructure fixture in said plurality of municipal infrastructure fixtures, at least one transmission in said plurality of transmissions including said unique identifier of said second installed wireless transceiver; receiving, from said database, said geographic coordinates of said second municipal infrastructure fixture, said received geographic coordinates determined by searching said database for said unique identifier contained in said received at least one transmission from said second installed wireless transceiver; and said movable device determining its geographic location using said received geographic coordinates for said second municipal infrastructure fixture.

In an embodiment of the method, said database is stored on a non-transitory computer-readable memory of said movable device.

In an embodiment of the method, said database is stored on a non-transitory computer-readable memory of a remote server computer and said geographic coordinates are received from said database over a telecommunications network by said second wireless transceiver transmitting to said remote server said received unique identifier and said remote server searching said database for said unique identifier.

In an embodiment of the method, said installed wireless transceivers comprise short-range beacons.

In an embodiment of the method, said movable device determining its geographic location using said received geographic coordinates is based at least in part on said receiving, at said second wireless transceiver, from said first installed wireless transceiver, said at least one transmission including said unique identifier of said first installed wireless transceiver indicating that, at the time of said receiving, said movable device is physically proximate to said first installed wireless transceiver.

In an embodiment of the method, said movable device further comprises a processing system and a non-transitory, computer-readable memory having program instructions stored thereon which, when executed by said processing system, cause said movable device to run software using said determined geographic location of said movable device.

In an embodiment of the method, said software comprises an operating system of said movable device.

In an embodiment of the method, said operating system makes said determined geographic coordinates available to application software running on said operating system via an application programming interface.

In an embodiment of the method, said software comprises one or more of the following: vehicular navigation, manual vehicular piloting assistance, route planning, route tracking, autonomous vehicle piloting assistance, traffic flow analysis, mapping, vehicle location, vehicle movement tracking, geofencing, couponing, a rewards program, marketing messaging, a game, a social network, or emergency notifications.

In an embodiment of the method, said movable device is a small vehicle in a shared fleet having a geographically defined operational range, and said determined location is used to inhibit operation of said movable device when said determined location is outside of defined operational range.

In an embodiment of the method, said plurality of municipal infrastructure poles are designed for a purpose other than geographic location, and are retrofitted with said installed wireless transceivers for geographic location.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A method of reducing bandwidth consumption in a municipal infrastructure comprising:

providing a plurality of municipal light poles, each municipal light pole in said plurality having:

a luminaire having a dimming receptacle disposed on an exterior surface thereof and a current operational state; and a wireless node operatively coupled to said luminaire via said dimming receptacle;

wherein said wireless nodes of said plurality of municipal light poles form a local mesh network, and at least one of said wireless nodes comprises a gateway node;

providing a server having a master state table containing data indicative of said current operational state of each of said luminaires, said server in communication with said at least one gateway node via a wide-area network;

storing, at said at least one gateway node, a copy of said master state table received from said server;

receiving, at said server, an instruction indicative of at least one luminaire of said plurality of municipal light poles, and a desired current operational state of said at least one luminaire; and determining, at said server, whether said master state table indicates that said current operational state of said at least one luminaire is said desired current operational state, and:

if said determining results in a determination that said current operational state of said at least one luminaire is not said desired current operational state:

updating, at said server, said master state table to indicate said desired current operational state for said at least one luminaire;

transmitting said identifier for said at least one luminaire and said desired current operational state to said at least one gateway node;

receiving, at said at least one gateway node, said identifier and said desired current operational state;

updating, at said at least one gateway node, said state table copy to indicate said desired current operational state for said at least one luminaire;

said at least one gateway node transmitting said identifier and said desired current operational state to other wireless nodes of said plurality of municipal light poles via said mesh network;

based on said identifier, said wireless node for said at least one luminaire operating said at least one luminaire to change said current operational state of said at least one luminaire to said desired current operational state; and if said determining results in a determination that said current operational state of said at least one luminaire is said desired current operational state:

not updating said state table in response to said instruction:

not transmitting to said first wireless node in response to said instruction.

2. The method of claim 1, further comprising:

said wireless node for said at least one luminaire transmitting to said at least one gateway node via said mesh network an acknowledgment of said operating said at least one luminaire to change said current operational state of said at least one luminaire to said desired current operational state to first wireless node via said mesh network;

said at least one gateway node updating said master state table copy to indicate said current operational state for said at least one luminaire is said desired current operational state for said at least one luminaire and said at least one gateway node transmitting said acknowledgment to said server; and at said server, receiving said acknowledgment and updating said master state table to indicate said current operational state for said at least one luminaire is said desired current operational state for said at least one luminaire.

3. The method of claim 1, further comprising:

providing an end-user computer; and before said receiving, at said server, an instruction indicative of at least one luminaire of said plurality of municipal light poles, and a desired current operational state of said at least one luminaire:

receiving, at said end-user computer, said instruction; and said end-user computer transmitting said instruction to said server.

4. The method of claim 3, wherein said end-user computer is selected from the group consisting of: a desktop computer, a laptop computer, a tablet computer, a smart phone, a vehicular computer, and a wearable computer.

5. The method of claim 1, wherein said mesh network is one or more of the following: a municipal mesh network or a private mesh network.

6. The method of claim 1, wherein said server is one or more of the following: a municipal server or a private server.

7. The method of claim 1, wherein, for each luminaire in said plurality of municipal light poles, said operational state is one or more of the following: powered, unpowered, color temperature, intensity, hue, or voltage.

8. The method of claim 7, wherein each of said luminaires comprises a municipal luminaire adapted to illuminate a roadway, and each of said second luminaires comprises a flexible tube mounted on an arm of said light pole anterior to said luminaire.

9. The method of claim 1, wherein each of said wireless nodes comprises a radio transceiver, a controller, and a memory.

10. The method of claim 1, wherein at least some of said wireless nodes comprise gateway nodes in wireless communication with said server over a wide-area network.

11. The method of claim 10, wherein each of said at least some of said wireless nodes comprise gateway nodes in wireless communication with said server over a wide-area network.

12. The method of claim 1, further comprising:

on a periodic basis and at a predetermined frequency, for each municipal light pole in said plurality of municipal light poles, said wireless node operating said luminaire to cause said current operational state of said luminaire to be the same as the current operational state indicated for said luminaire in said master state table copy.

13. The method of claim 1, further comprising:

on a periodic basis and at a predetermined frequency, for each gateway node in said at least one gateway nodes, receiving a current copy of said master state table from said server and causing said master state table copy to be the same as said received copy of said master state table.

14. The method of claim 1, further comprising:

a first municipal light pole in said providing a plurality of municipal light poles further comprising at least a first sensor operatively and communicatively coupled to said wireless node;

said at least a first sensor generating data about the environment proximate to said municipal light pole;

said wireless node receiving said generated data and transmitting, via said mesh network, said generated data to said at least one gateway node; and said at least one gateway node receiving said generated data via said mesh network and transmitting said generated data, via said wide-area network, to said server.

15. The method of claim 14, wherein said sensor is selected from the group consisting of: a parking sensor, a pedestrian sensor, a traffic sensor, an occupancy sensor, a light sensor, a noise sensor, a smoke sensor, an optical sensor, a camera, an air quality sensor, a pollutant sensor, a pollen sensor, a snow accumulation sensor, a weather sensor, a temperature sensor, a rain sensor, a humidity sensor, a barometer, a water level sensor, an earthquake sensor, an avalanche sensor, a seismic activity sensor, a wave sensor, a carbon dioxide sensor, a carbon monoxide sensor, a gas sensor, a radiological sensor, or an Internet-of-Things (IoT) sensor.

16. The method of claim 14, wherein said sensor receives end-user instructions transmitting to said server by an end-user by said server transmitting said instructions to said at least one gateway node and said at least one gateway node transmitting said instructions via said mesh network.

17. The method of claim 14, wherein each of said municipal light poles comprises:

a municipal alternating current (AC) electric power line in electrical communication with said luminaire at a municipal distribution voltage; and a power converter receiving said electric power and converting said AC current to direct current (DC) at a device voltage, said device voltage being lower than said municipal voltage.

18. The method of claim 17, wherein said municipal distribution voltage is between about 110 and 480 volts AC and said device voltage is between about 0 and 10 volts DC.

19. The method of claim 18, wherein said power converter is enclosed within said wireless node.

* * * * *